US011326787B2

(12) United States Patent
Miyawaki et al.

(10) Patent No.: US 11,326,787 B2
(45) Date of Patent: May 10, 2022

(54) REFRIGERANT DISTRIBUTOR AND AIR-CONDITIONING APPARATUS

(71) Applicant: Mitsubishi Electric Corporation, Chiyoda-ku (JP)

(72) Inventors: Kosuke Miyawaki, Chiyoda-ku (JP); Yoji Onaka, Chiyoda-ku (JP); Osamu Morimoto, Chiyoda-ku (JP); Hiroyuki Okano, Chiyoda-ku (JP); Takanori Koike, Chiyoda-ku (JP); Hiroki Maruyama, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 42 days.

(21) Appl. No.: 16/636,833

(22) PCT Filed: Sep. 25, 2017

(86) PCT No.: PCT/JP2017/034443

§ 371 (c)(1),
(2) Date: Feb. 5, 2020

(87) PCT Pub. No.: WO2019/058540

PCT Pub. Date: Mar. 28, 2019

(65) Prior Publication Data

US 2020/0271333 A1 Aug. 27, 2020

(51) Int. Cl.
*F24F 1/30* (2011.01)
*F24F 1/28* (2011.01)
(Continued)

(52) U.S. Cl.
CPC ..... *F24F 1/30* (2013.01); *F24F 1/28* (2013.01); *F25B 39/028* (2013.01); *F25B 41/40* (2021.01);
(Continued)

(58) Field of Classification Search
CPC ..... F25B 6/02; F25B 5/02; F25B 2313/0253; F25B 2313/02323; F25B 41/42;
(Continued)

(56) References Cited

U.S. PATENT DOCUMENTS

2005/0212287 A1 9/2005 Caro
2010/0199695 A1* 8/2010 Shinozaki ..... F24F 1/28 62/238.7
2015/0101363 A1* 4/2015 Matsuda ..... F28F 9/0202 62/525

FOREIGN PATENT DOCUMENTS

JP 62-119374 A 5/1987
JP 8-159615 A 6/1996
(Continued)

OTHER PUBLICATIONS

Extended European Search Report dated Sep. 9, 2020 in European Patent Application No. 17926002.1, 7 pages.
(Continued)

*Primary Examiner* — Joseph F Trpisovsky
(74) *Attorney, Agent, or Firm* — Xsensus LLP

(57) ABSTRACT

A refrigerant distributor branches refrigerant flowing in a refrigerant circuit into three, and includes a first bifurcate flow divider including a first pipe portion forming one inflow port, a second pipe portion and a third pipe portion forming two outflow ports communicating with the inflow port of the first pipe portion, and a second bifurcate flow divider including a fourth pipe portion forming one inflow port, and a fifth pipe portion and a sixth pipe portion forming two outflow ports communicating with the inflow port of the fourth pipe portion. The outflow port of the third pipe portion and the inflow port of the fourth pipe portion communicate with each other, and an angle θ formed by a first plane passing through the first bifurcate flow divider and a second plane passing through the second bifurcate flow divider is between 60 and 120 degrees.

8 Claims, 15 Drawing Sheets

(51) Int. Cl.
*F25B 41/42* (2021.01)
*F25B 39/02* (2006.01)
*F25B 41/40* (2021.01)

(52) U.S. Cl.
CPC ..... *F25B 41/42* (2021.01); *F25B 2313/0253* (2013.01); *F25B 2400/0409* (2013.01)

(58) Field of Classification Search
CPC ..... F25B 41/40; F25B 2400/0409; F25B 39/028; F24F 1/68; F24F 1/30; F24F 1/28; F16L 41/023
See application file for complete search history.

(56) References Cited

FOREIGN PATENT DOCUMENTS

| | | | |
|---|---|---|---|
| JP | 10-103814 | A | 4/1998 |
| JP | 2001-090893 | A | 4/2001 |
| JP | 2010-127601 | A | 6/2010 |
| KR | 10-2009-0052062 | A | 5/2009 |

OTHER PUBLICATIONS

Office Action dated Oct. 6, 2020 in Japanese Patent Application No. 2019-542941, 6 pages.
International Search Report dated Dec. 12, 2017 in PCT/JP2017/034443 filed Sep. 25, 2017, citing documents AO-AP therein, 2 pages.

* cited by examiner

REFRIGERANT DISTRIBUTOR AND AIR-CONDITIONING APPARATUS

TECHNICAL FIELD

The present invention relates to a refrigerant distributor, and an air-conditioning apparatus including the refrigerant distributor.

BACKGROUND ART

In some air-conditioning apparatus, liquid refrigerant condensed in a heat exchanger used as a condenser installed in an indoor unit is decompressed by an expansion valve, and is brought into a two-phase gas-liquid state in which gas refrigerant and liquid refrigerant are mixed. The refrigerant in the two-phase gas-liquid state flows into a heat exchanger installed in an outdoor unit and used as an evaporator. When three or more evaporators are installed in the outdoor unit and the three evaporators are connected in parallel to each other in a refrigerant circuit, it is necessary to distribute the two-phase gas-liquid refrigerant to three directions. To distribute the two-phase gas-liquid refrigerant to the three directions, the method is provided in which two flow dividers of bifurcation structures such as Y-shaped pipes are combined to perform bifurcation distributions in two stages, and thereby trifurcation distribution is achieved (for example, see Patent Literature 1).

CITATION LIST

Patent Literature

Patent Literature 1: Japanese Unexamined Patent Application Publication No. 2010-127601

SUMMARY OF INVENTION

Technical Problem

When some air-conditioning apparatus performs the trifurcation distribution, a gas-liquid interface of refrigerant in an outflow port is biased in the first flow divider performing a distribution of the first stage, so that the refrigerant with a biased gas-liquid distribution flows in the second flow divider, and a gas-liquid distribution in the second stage may be uneven. As a result, in the air-conditioning apparatus, heat exchange performance of the evaporators may be reduced.

The present invention is to solve the problem as described above, and is to provide a refrigerant distributor that reduces unevenness of a gas-liquid distribution in a second stage in an air-conditioning apparatus performing a trifurcation distribution, and the air-conditioning apparatus.

Solution to Problem

A refrigerant distributor according to an embodiment of the present invention is a refrigerant distributor branching refrigerant flowing in a refrigerant circuit into three, and includes a first bifurcate flow divider including a first pipe portion forming one inflow port at a lower end, a second pipe portion and a third pipe portion forming two outflow ports communicating with the inflow port of the first pipe portion, at upper ends, and a second bifurcate flow divider including a fourth pipe portion forming one inflow port at a lower end, and a fifth pipe portion and a sixth pipe portion forming two outflow ports communicating with the inflow port of the fourth pipe portion, at upper ends. The outflow port of the third pipe portion and the inflow port of the fourth pipe portion communicate with each other, and an angle θ formed by a first plane passing through a center point of each of the one inflow port and the two outflow ports of the first bifurcate flow divider and a second plane passing through a center point of each of the one inflow port and the two outflow ports of the second bifurcate flow divider is 60 degrees or more and 120 degrees or less.

Advantageous Effects of Invention

In the refrigerant distributor according to an embodiment of the present invention, the angle θ formed by the first plane passing through the center points of the one inflow port and the two outflow ports of the first bifurcate flow divider, and the second plane passing through the center points of the one inflow port and the two outflow ports of the second bifurcate flow divider is 60 degrees or more and 120 degrees or less. As the refrigerant distributor includes the above described configuration, a direction of a centrifugal force acting on the liquid refrigerant in the second bifurcate flow divider differs from a direction of a centrifugal force acting on the liquid refrigerant in the first bifurcate flow divider. Consequently, the refrigerant distributor can reduce a bias of the liquid refrigerant to one passage in the second bifurcate flow divider caused by a bias of the liquid refrigerant in the outlet port of the first bifurcate flow divider, and can reduce reduction in distribution performance of two-phase gas-liquid refrigerant. As a result, in the air-conditioning apparatus of an embodiment of the present invention, proper two-phase gas-liquid distribution to the three outdoor heat exchangers is enabled, and heat exchange performance of the outdoor heat exchangers can be enhanced.

DESCRIPTION OF EMBODIMENTS

Hereinafter, a trifurcate distributor 10 and an air-conditioning apparatus 200 according to embodiments of the present invention will be described with reference to the drawings and other description. Note that in the following drawings including FIG. 1, a relative dimensional relationship, shapes, and other aspects of components may differ from an actual relative dimensional relationship, shapes, and other aspects of the components. In the following drawings, components assigned with the same reference signs are the same or equivalent components, and this note is common in the entire text of the specification. While terms representing directions (for example, "up", "down", "right", "left", "front", and "rear") are properly used to facilitate understanding, the terms are only for convenience of explanation, but do not limit dispositions and orientations of devices or components.

Embodiment 1

[Configuration of Air-Conditioning Apparatus]

Figure 1:
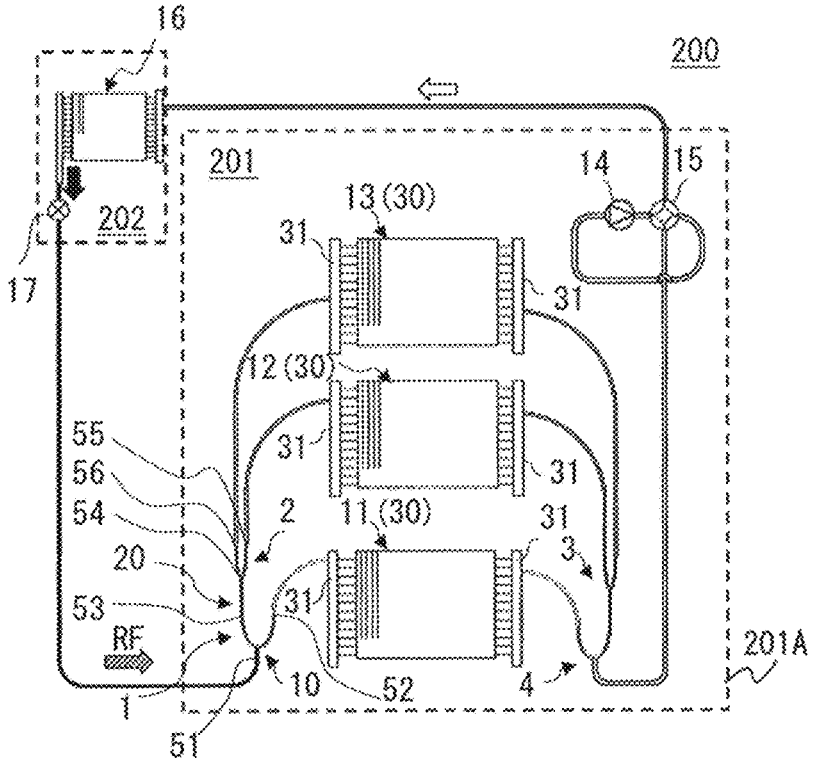
FIG. 1 is a configuration diagram of an air-conditioning apparatus including a trifurcate distributor according to Embodiment 1 of the present invention.

FIG. 1 is a configuration diagram of an air-conditioning apparatus 200 including a trifurcate distributor 10 according to Embodiment 1 of the present invention. An arrow of a solid line in FIG. 1 shows a flow of refrigerant during a heating operation in the air-conditioning apparatus 200. The air-conditioning apparatus 200 in FIG. 1 has an outdoor unit 201 and an indoor unit 202, and the outdoor unit 201 and the indoor unit 202 are connected by a refrigerant pipe. In the air-conditioning apparatus 200, a compressor 14, a flow switching device 15, an indoor heat exchanger 16, a decompressing device 17, a trifurcate distributor 10, and outdoor heat exchangers 30 are sequentially connected through refrigerant pipes. Note that a configuration of the air-conditioning apparatus 200 shown in FIG. 1 is only an example, and, for example, a muffler, and an accumulator may be provided in the air-conditioning apparatus 200.

(Indoor Unit 202)

The indoor unit 202 has the indoor heat exchanger 16 and the decompressing device 17. The indoor heat exchanger 16 exchanges heat between air to be conditioned and refrigerant. The indoor heat exchanger 16 is used as a condenser during a heating operation, and condenses refrigerant and liquefies the refrigerant. Furthermore, the indoor heat exchanger 16 is used as an evaporator during a cooling operation, evaporates refrigerant and gasifies the refrigerant. In a vicinity of the indoor heat exchanger 16, a fan not illustrated may be provided to face the indoor heat exchanger 16. The decompressing device 17 is an expansion device (flow control unit), and is used as an expansion valve, by regulating a flow of the refrigerant flowing in the decompressing device 17, to expand the refrigerant that flows in and thus to decompress the refrigerant. When the decompressing device 17 is an electronic expansion valve, for example, an opening degree is controlled in accordance with an instruction of a controller (not illustrated) or other similar component. Note that in FIG. 1, the decompressing device 17 is disposed in the indoor unit 202, but may be disposed in the outdoor unit 201 instead of being disposed in the indoor unit 202.

(Outdoor Unit 201)

The outdoor unit 201 has the compressor 14, the flow switching device 15, the outdoor heat exchangers 30, and the trifurcate distributor 10. The compressor 14 compresses sucked refrigerant and discharges the refrigerant. The flow switching device 15 is, for example, a four-way valve, and is a device that switches directions of the refrigerant passage. The air-conditioning apparatus 200 can switch a heating operation and a cooling operation to perform the heating operation and the cooling operation, by switching the directions in which the refrigerant flows by using the flow switching device 15.

(Outdoor Heat Exchanger 30)

The outdoor heat exchanger 30 exchanges heat between refrigerant and outdoor air. The outdoor heat exchanger 30 is used as an evaporator during a heating operation, evaporates the refrigerant, and gasifies the refrigerant. Furthermore, the outdoor heat exchanger 30 is used as a condenser during a cooling operation, and condenses the refrigerant to liquefy the refrigerant. In a vicinity of the outdoor heat exchanger 30, a fan not illustrated may be provided. A distributor 31 is each provided at an inlet port and an outlet port of the outdoor heat exchanger 30, as illustrated in FIG. 1. The distributor 31 may be a header distributor, or may be a collision distributor having branched pipes. The outdoor heat exchanger 30 of the air-conditioning apparatus 200 has three heat exchangers that are a first outdoor heat exchanger 11, a second outdoor heat exchanger 12, and a third outdoor heat exchanger 13. The first outdoor heat exchanger 11, the second outdoor heat exchanger 12, and the third outdoor heat exchanger 13 are connected in parallel to each other in a portion of a refrigerant circuit between the decompressing device 17 and the compressor 14. The number of outdoor heat exchangers 30 mounted on the outdoor unit 201 shown in FIG. 1 is three, but at least the three outdoor heat exchangers 30 are only required to be connected in parallel to each other, and four or more outdoor heat exchangers 30 may be connected. Furthermore, a heat transfer tube of the outdoor heat exchanger 30 installed in on the outdoor unit 201 may be disposed horizontally, or may be disposed vertically. To divide a flow of the refrigerant to the first outdoor heat exchanger 11, the second outdoor heat exchanger 12, and the third outdoor heat exchanger 13 connected in parallel to each other, the trifurcate distributor 10 is connected to the inlet ports of these heat exchangers through the corresponding ones of the distributors 31. Note that as shown in FIG. 1, an outflow port of the trifurcate distributor 10 and the corresponding ones of the distributors 31 of the outdoor heat exchangers 30 may be directly connected by refrigerant pipes, or a flow control valve or other similar component may be placed between the outflow port of the trifurcate distributor 10 and one or more of the corresponding ones of the distributors 31 of the outdoor heat exchangers 30.

(Trifurcate Distributor 10)

Figure 2:
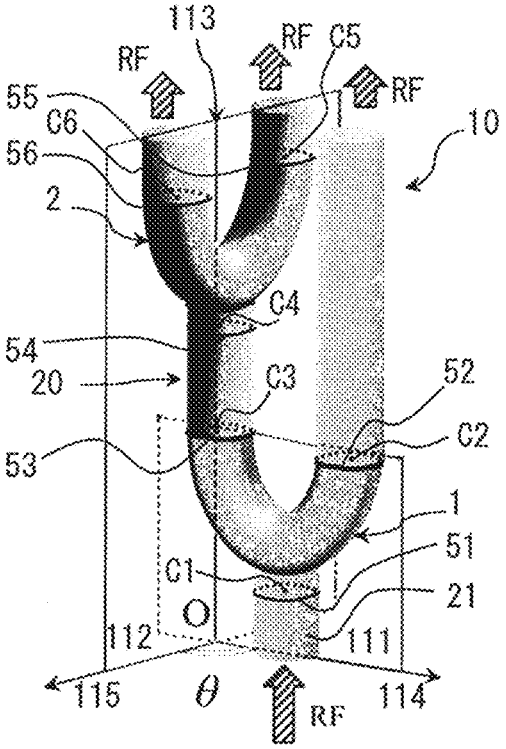
FIG. 2 is a perspective view of the trifurcate distributor according to Embodiment 1 of the present invention.

FIG. 2 is a perspective view of the trifurcate distributor 10 according to Embodiment 1 of the present invention. The trifurcate distributor 10 branches the refrigerant flowing in the refrigerant circuit into three, and divides flow of the refrigerant to the first outdoor heat exchanger 11, the second outdoor heat exchanger 12, and the third outdoor heat exchanger 13, which are connected in parallel to each other. Note that the trifurcate distributor 10 corresponds to a "refrigerant distributor" of the present invention. As shown in FIG. 2, the trifurcate distributor 10 has a first bifurcate flow divider 1 and a second bifurcate flow divider 2. Furthermore, the trifurcate distributor 10 has a connection pipe 20 connecting the first bifurcate flow divider 1 and the second bifurcate flow divider 2, and an inlet pipe 21 connected to an inflow port 51 of the first bifurcate flow divider 1. The connection pipe 20 is a straight pipe circular in section. As shown in FIG. 1 and FIG. 2, an outflow port 52 of the first bifurcate flow divider 1 is connected to the first outdoor heat exchanger 11, and an outflow port 53 of the first bifurcate flow divider 1 communicates with an inflow port 54 of the second bifurcate flow divider 2. An outflow port 55 of the second bifurcate flow divider 2 is connected to the second outdoor heat exchanger 12, and an outflow port 56 of the second bifurcate flow divider 2 is connected to the third outdoor heat exchanger 13. Furthermore, in the trifurcate distributor 10, the inlet pipe 21 is connected to the inflow port 51 of the first bifurcate flow divider 1 vertically upward, and the connection pipe 20 connecting the first bifurcate flow divider 1 and the second bifurcate flow divider 2 is connected to the inflow port 54 of the second bifurcate flow divider 2 vertically upward.

(First Bifurcate Flow Divider 1)

Figure 3:
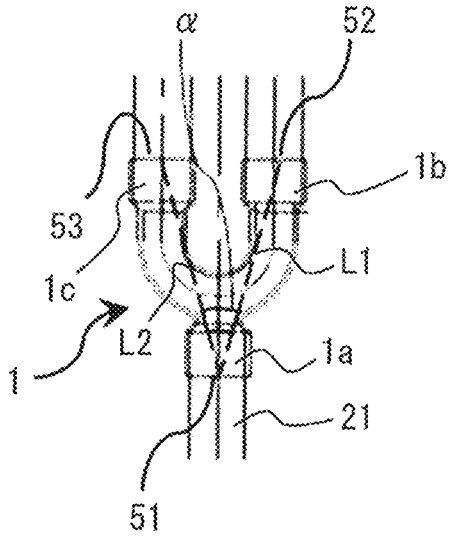
FIG. 3 is a schematic front view of a first bifurcate distributor included in the trifurcate distributor in FIG. 2.

FIG. 3 is a schematic front view of the first bifurcate flow divider 1 included in the trifurcate distributor 10 in FIG. 2. Here, the first bifurcate flow divider 1 will be described with use of FIG. 3. The first bifurcate flow divider 1 branches the refrigerant that flows in from one end portion into two and causes the refrigerant to flow out to the other end portions. The first bifurcate flow divider 1 has a first pipe portion 1*a* forming the one inflow port 51 at a lower end, and a second pipe portion 1*b* and a third pipe portion 1*c* that form the two outflow ports that are the outflow port 52 and the outflow port 53 that communicate with the inflow port 51 of the first pipe portion 1*a*, at upper ends. In the first bifurcate flow divider 1, the two outflow ports 52 and 53 open opposite to the inflow port 51. The inflow port 51 is a circular opening port located at an end portion of the first pipe portion 1*a*. The outflow port 52 is a circular opening port located at an end portion of the second pipe portion 1*b*. The outflow port 53 is a circular opening port located at an end portion of the third pipe portion 1*c*. A center line of the first pipe portion 1*a* forming the inflow port 51, a center line of the second pipe portion 1*b* forming the outflow port 52, and a center line of the third pipe portion 1*c* forming the outflow port 53 are on the same plane. The first bifurcate flow divider 1 is formed into a Y-shape, and an angle $\alpha$ between a virtual line L1 connecting a center point of the inflow port 51 and a center point of the outflow port 52, and a virtual line L2 connecting the center point of the inflow port 51 and a center point of the outflow port 53 is smaller than 180 degrees.

When a configuration of the pipe from the inflow port 51 to the outflow port 52 and the outflow port 53 is seen in a direction in which the refrigerant flows, in a configuration from the first pipe portion 1*a* to the second pipe portion 1*b* and the third pipe portion 1*c*, the center lines of the second pipe portion 1*b* and the third pipe portion 1*c* are each separated at an angle of 90 degrees or less from the center line of the first pipe portion 1*a*. Subsequently, the center line of the second pipe portion 1*b* and the center line of the third pipe portion 1*c* extend in a direction along an extension line of the center line of the first pipe portion 1*a*. In other words, in the first bifurcate flow divider 1, the second pipe portion 1*b* and the third pipe portion 1*c* are separated in opposite directions to each other and each oriented at an angle forming substantially 90 degrees between the first pipe portion 1*a* and the corresponding one of the second pipe portion 1*b* and the third pipe portion 1*c*, at a branch point of the second pipe portion 1*b* and the third pipe portion 1*c*. A subsequent portion of the first bifurcate flow divider 1 is a pipe smoothly curved in which angles between virtual lines each connecting the center point of the inflow port 51 and the corresponding one of center points of pipe sections of the second pipe portion 1*b* and the third pipe portion 1*c*, and the extension line of the center line of the first pipe portion 1*a* gradually decrease in a short distance within five times as large as a pipe diameter. In this case, the first bifurcate flow divider 1 is in a shape in which the first pipe portion 1*a* forming the inflow port 51 is connected to a middle point of a folded part of a U-shaped pipe connecting the outflow port 52 and the outflow port 53. As the pipe is curved in the distance within five times as large as the pipe diameter, some part of the branch point is not in a circular pipe shape, and may be in a complicated three-dimensional shape that connects the second pipe portion 1*b* forming the outflow port 52 and the third pipe portion 1*c* forming the outflow port 53.

In the first bifurcate flow divider 1, the second pipe portion 1*b* forming the outflow port 52 and the third pipe portion 1*c* forming the outflow port 53 are pipes in symmetrical shapes. The center line of the second pipe portion 1*b* passing through the center point of the outflow port 52 and the center line of the third pipe portion c passing through the center point of the outflow port 53 are opposite to each other across the center line of the first pipe portion 1*a* passing through the center point of the inflow port 51, which is regarded as a boundary. A diameter of the second pipe portion 1*b* forming the outflow port 52, and a diameter of the third pipe portion 1*c* forming the outflow port 53 may have the same sizes, or different sizes. When a size of the diameter of the second pipe portion 1*b* and a size of the diameter of the third pipe portion 1*c* differ, a large amount of refrigerant is supplied to the outflow port of the pipe portion having a large diameter. In this case, the center line of the second pipe portion 1*b* passing through the center point of the outflow port 52, and the center line of the third pipe portion c passing through the center point of the outflow port 53 do not have to be located at symmetrical distances about the center line of the first pipe portion 1*a* passing through the center point of the inflow port 51. In other words, either one center line of the center line of the second pipe portion 1*b* passing through the center point of the outflow port 52, and the center line of the third pipe portion 1*c* passing through the center point of the outflow port 53 may be located close to the center line of the first pipe portion 1*a*. Note that inside of the first bifurcate flow divider 1, a mechanism that forms a constriction portion similar to a partition plate does not exist.

(Second Bifurcate Flow Divider 2)

Figure 4:
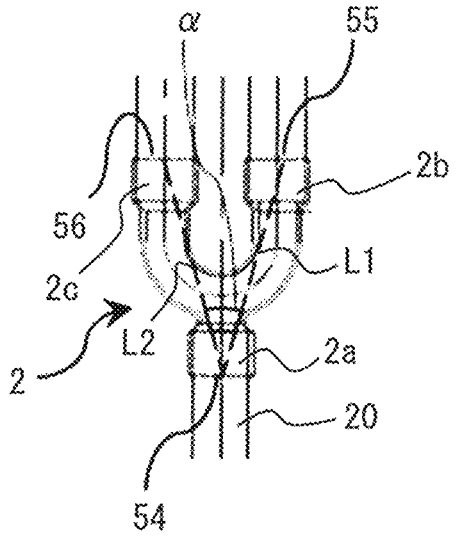
FIG. 4 is a schematic front view of a second bifurcate distributor included in the trifurcate distributor in FIG. 2.

FIG. 4 is a schematic front view of the second bifurcate flow divider 2 included in the trifurcate distributor 10 in FIG. 2. Here, the second bifurcate flow divider 2 will be described with use of FIG. 4. The second bifurcate flow divider 2 causes refrigerant flowing in from one end portion to branch into two and to flow out to the other end portions. The second bifurcate flow divider 2 has a fourth pipe portion 2*a* forming one inflow port 54 at a lower end, and a fifth pipe portion 2*b* forming an outflow port 55 and a sixth pipe portion 2*c* forming an outflow port 56 that communicate with the inflow port 54 of the fourth pipe portion 2*a*, at upper ends. In the second bifurcate flow divider 2, two of the outflow port 55 and the outflow port 56 open opposite to the inflow port 54. The inflow port 54 is a circular opening port located in an end portion of the fourth pipe portion 2*a*. The outflow port 55 is a circular opening port located in an end portion of the fifth pipe portion 2*b*. The outflow port 56 is a circular opening port located in an end portion of the sixth pipe portion 2*c*. A center line of the fourth pipe portion 2*a* forming the inflow port 54, a center line of the fifth pipe portion 2*b* forming the outflow port 55, and a center line of the sixth pipe portion 2*c* forming the outflow port 56 are on the same plane. The second bifurcate flow divider 2 is formed into a Y-shape, and an angle $\alpha$ between a virtual line L1 connecting a center point of the inflow port 54 and a center point of the outflow port 55, and a virtual line L2 connecting the center point of the inflow port 54 and a center point of the outflow port 56 is smaller than 180 degrees.

When a configuration of the pipe from the inflow port 54 to the outflow port 55 and the outflow port 56 is seen in a direction in which the refrigerant flows, in a configuration from the fourth pipe portion 2*a* to the fifth pipe portion 2*b* and the sixth pipe portion 2*c*, the center lines of the fifth pipe portion 2*b* and the sixth pipe portion 2*c* are each separated at an angle of 90 degrees or less from the center line of the fourth pipe portion 2*a*. Subsequently, the center line of the fifth pipe portion 2*b* and the center line of the sixth pipe portion 2*c* extend in a direction along an extension line of the center line of the fourth pipe portion 2*a*. In other words, in the second bifurcate flow divider 2, the fifth pipe portion 2*b* and the sixth pipe portion 2*c* are separated in opposite directions to each other and each oriented at an angle forming substantially 90 degrees between the fourth pipe portion 2*a* and the corresponding one of the fifth pipe portion 2*b* and the sixth pipe portion 2*c*, at a branch point of the fifth pipe portion 2*b* and the sixth pipe portion 2*c*. A subsequent portion of the second bifurcate flow divider 2 is a pipe smoothly curved in which angles between virtual lines each connecting the center point of the inflow port 54 and the corresponding one of center points of pipe sections of the fifth pipe portion 2*b* and the sixth pipe portion 2*c*, and the extension line of the center line of the fourth pipe portion 2*a* gradually decrease in a short distance within five times as large as a pipe diameter. In this case, the second bifurcate flow divider 2 is in a shape in which the fourth pipe portion 2*a* forming the inflow port 54 is connected to a middle point of a folded part of a U-shaped pipe connecting the outflow port 55 and the outflow port 56. As the pipe is curved in the distance within five times as large as the pipe diameter, some part of the branch point is not in a circular pipe shape, and may be in a complicated three-dimensional shape that connects the fifth pipe portion 2*b* forming the outflow port 55 and the sixth pipe portion 2*c* forming the outflow port 56.

In the second bifurcate flow divider 2, the fifth pipe portion 2*b* forming the outflow port 55 and the sixth pipe portion 2*c* forming the outflow port 56 are pipes in symmetrical shapes. The center line of the fifth pipe portion 2*b* passing through the center point of the outflow port 55, and the center line of the sixth pipe portion 2*c* passing through the center point of the outflow port 56 are opposite to each other across the center line of the fourth pipe portion 2*a* passing through the center point of the inflow port 54, which is regarded as a boundary. A diameter of the fifth pipe portion 2*b* forming the outflow port 55, and a diameter of the sixth pipe portion 2*c* forming the outflow port 56 may have the same sizes, or different sizes. When a size of the diameter of the fifth pipe portion 2*b* and a size of the diameter of the sixth pipe portion 2*c* differ, a large amount of refrigerant is supplied to the outflow port of the pipe portion having a large diameter. In this case, the center line of the fifth pipe portion 2*b* passing through the center point of the outflow port 55, and the center line of the sixth pipe portion 2*c* passing through the center point of the outflow port 56 do not have to be located at symmetrical distances from the center line of the fourth pipe portion 2*a* passing through the center point of the inflow port 54. In other words, either one center line of the center line of the fifth pipe portion 2*b* passing through the center point of the outflow port 55, and the center line of the sixth pipe portion 2*c* passing through the center point of the outflow port 56 may be located close to the center line of the fourth pipe portion 2*a*. Note that inside of the second bifurcate flow divider 2, a mechanism that forms a constriction portion similar to a partition plate does not exist.

As shown in FIG. 2, the connection pipe 20 has an upper end connecting to the fourth pipe portion 2*a* vertically upward, and a lower end connecting to the third pipe portion 1*c*. Note that the fourth pipe portion 2*a* forming the inflow port 54 may be directly connected to the third pipe portion 1*c* forming the outflow port 53, or indirectly connected to the third pipe portion 1*c* forming the outflow port 53 via another pipe different from the connection pipe 20. The inlet pipe 21 has an upper end connecting to the first pipe portion 1*a* vertically upward, and a lower end connecting to the refrigerant circuit leading to the decompressing device 17.

Figure 5:
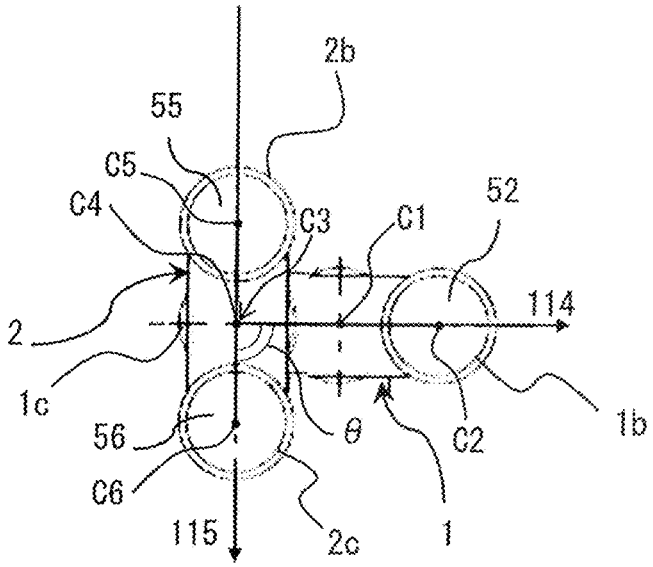
FIG. 5 is a schematic plan view of the trifurcate distributor in FIG. 2

FIG. 5 is a schematic plan view of the trifurcate distributor 10 in FIG. 2. Here, an angle θ formed by two planes that are a plane 111 formed by a branch direction of the first bifurcate flow divider 1, and a plane 112 formed by a branch direction of the second bifurcate flow divider 2 will be described with use of FIG. 2 and FIG. 5. The plane 111 is a plane including a straight line connecting a center point C1 of the inflow port 51 and a center point C2 of the outflow port 52, and a straight line connecting the center point C1 of the inflow port 51 and a center point C3 of the outflow port 53. In other words, the plane 111 is a plane passing through the center point C1 of the one inflow port 51 of the first bifurcate flow divider 1, and the center points of the two outflow ports that are the center point C2 of the outflow port 52 and the center point C3 of the outflow port 53. Likewise, the plane 112 is a plane including a straight line connecting a center point C4 of the inflow port 54, and a center point C5 of the outflow port 55, and a straight line connecting the center point C4 of the inflow port 54 and a center point C6 of the outflow port 56. In other words, the plane 112 is a plane passing through the center point C4 of the one inflow port 54 of the second bifurcate flow divider 2, and the center points of the two outflow ports that are the center point C5 of the outflow port 55 and the center point C6 of the outflow port 56. When an angle in a horizontal direction formed by the two planes that are the plane 111 formed by the branch direction of the first bifurcate flow divider 1, and the plane 112 formed by the branch direction of the second bifurcate flow divider 2 is specified as the angle θ in the trifurcate distributor 10, the angle θ is an angle of 60 degrees or more and 120 degrees or less. Note that the angle θ formed by the two planes that are the plane 111 and the plane 112 is an angle formed by a line 114 on the plane 111 passing through a point O on an intersection line 113 of the plane 111 and the plane 112 and orthogonal to the intersection line 113, and a line 115 on the plane 112 passing through the point O and orthogonal to the intersection line 113. Furthermore, the plane 111 corresponds to a "first plane" of the present invention, and the plane 112 corresponds to a "second plane" of the present invention.

[Operation of Air-Conditioning Apparatus 200]

Figure 6:
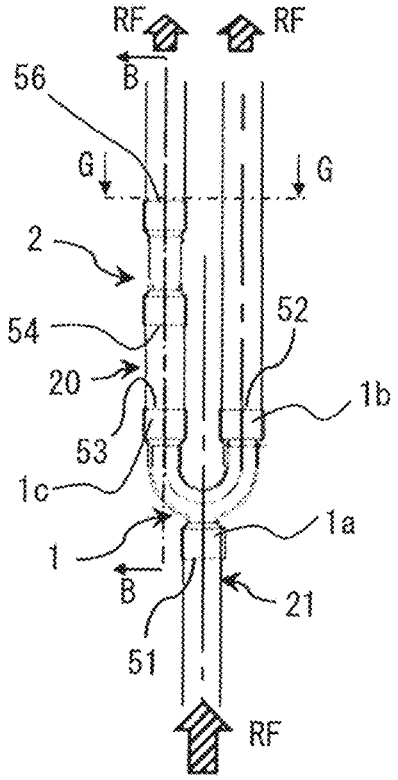
FIG. 6 is a schematic front view of the trifurcate distributor in FIG. 2.
Figure 7:
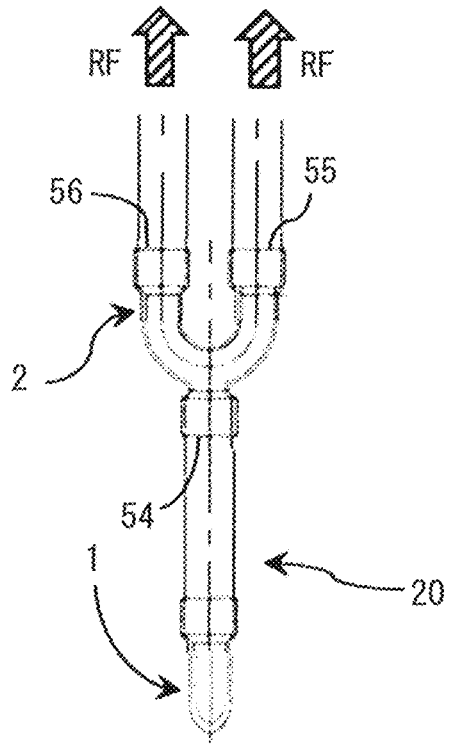
FIG. 7 is a schematic side view at a position of line B-B in the trifurcate distributor in FIG. 6.

FIG. 6 is a schematic front view of the trifurcate distributor 10 in FIG. 2. FIG. 7 is a schematic side view in a position along line B-B in the trifurcate distributor in FIG. 6. In FIG. 2, FIG. 6 and FIG. 7, upward arrows each shows a flow of refrigerant. Next, an operation of the air-conditioning apparatus 200 according to Embodiment 1 will be described with a heating operation as an example. As shown in FIG. 1, liquid refrigerant that is subcooled by supplying heat to indoor air in the indoor heat exchanger 16 is decompressed by the decompressing device 17 to be two-phase gas-liquid refrigerant, and flows into the trifurcate distributor 10.

Figure 8:
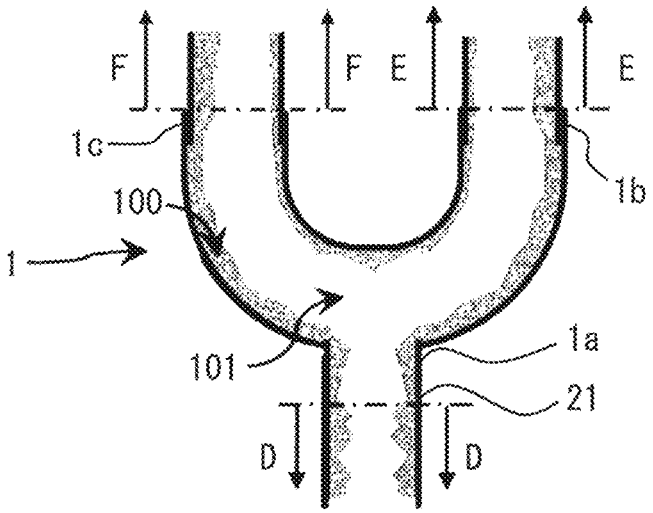
FIG. 8 is a schematic sectional view of the first bifurcate distributor shown in FIG. 3.
Figure 9:
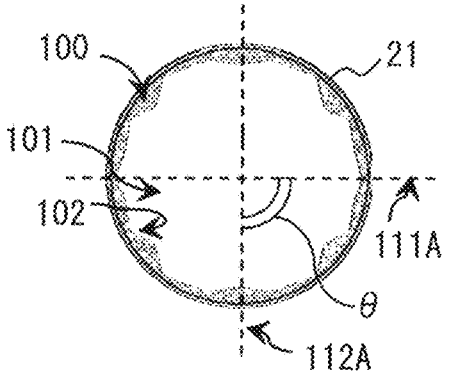
FIG. 9 is a schematic sectional view taken along line D-D of an inlet pipe connected to the first bifurcate distributor shown in FIG. 8.

FIG. 8 is a schematic sectional view of the first bifurcate flow divider 1 shown in FIG. 3. FIG. 9 is a schematic sectional view taken along line D-D of the inlet pipe 21 connected to the first bifurcate flow divider 1 shown in FIG. 8. Note that a plane 111A shown in FIG. 9 and the following drawings is a plane parallel with the plane 111, and a plane 112A is a plane parallel with the plane 112. As shown in FIG. 5, the two-phase gas-liquid refrigerant flowing in the trifurcate distributor 10 rises upward in in a direction opposite to a gravity direction through the inlet pipe 21 connected to the first bifurcate flow divider 1. As shown in FIG. 8 and FIG. 9, the two-phase gas-liquid refrigerant flowing in the inlet pipe 21 forms a gas-liquid interface 102 of an annular flow or a chum flow in which a lot of liquid refrigerant 100 is distributed on an inner wall in the pipe, and a lot of gas refrigerant 101 is distributed in a center in the pipe. The two-phase gas-liquid refrigerant flowing in the inlet pipe 21 and rises upward in a direction opposite to the gravity direction flows into the first bifurcate flow divider 1 from the inflow port 51 of the first pipe portion 1*a* shown in FIG. 5.

Figure 10:
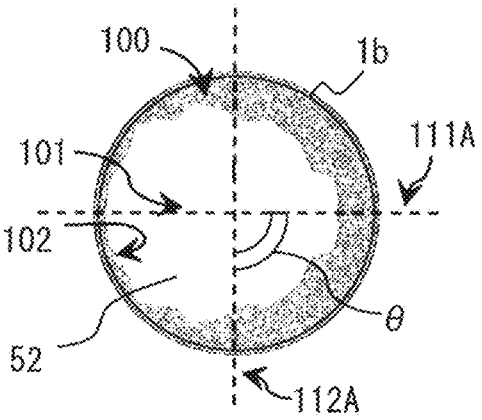
FIG. 10 is a schematic sectional view taken along line E-E in the first bifurcate distributor shown in FIG. 8.
Figure 11:
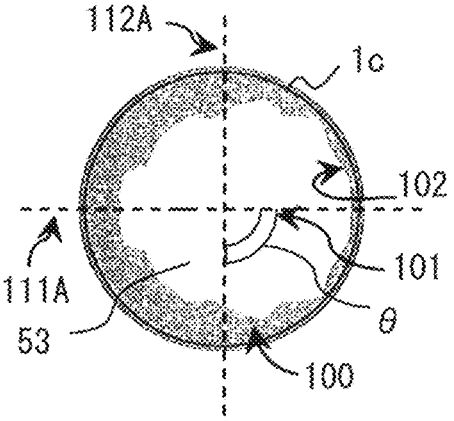
FIG. 11 is a schematic sectional view taken along line F-F in the first bifurcate distributor shown in FIG. 8.

FIG. 10 is a schematic sectional view taken along line E-E in the first bifurcate flow divider 1 shown in FIG. 8. FIG. 11 is a schematic sectional view taken along line F-F in the first bifurcate flow divider 1 shown in FIG. 8. The two-phase gas-liquid refrigerant flowing into the first bifurcate flow divider 1 from the inflow port 51 flows in the pipes by being divided to the second pipe portion 1*b* forming the outflow port 52 and the third pipe portion 1*c* forming the outflow port 53. As shown in FIG. 10 and FIG. 11, in the second pipe portion 1*b* and the third pipe portion 1*c*, the liquid refrigerant 100 is distributed by being biased in a direction parallel with the plane 111A in the pipes. In other words, in the second pipe portion 1*b*, the liquid refrigerant 100 is distributed by being biased on an inner wall located opposite to the third pipe portion 1*c* is located, and in the third pipe portion 1*c*, the liquid refrigerant 100 is distributed by being biased on an inner wall located opposite to the second pipe portion 1*b* is located, as shown in FIG. 10 and FIG. 11. Subsequently, the refrigerant flows from the outflow port 52 to the first outdoor heat exchanger 11, and flows from the outflow port 53 to the connection pipe 20.

Figure 12:
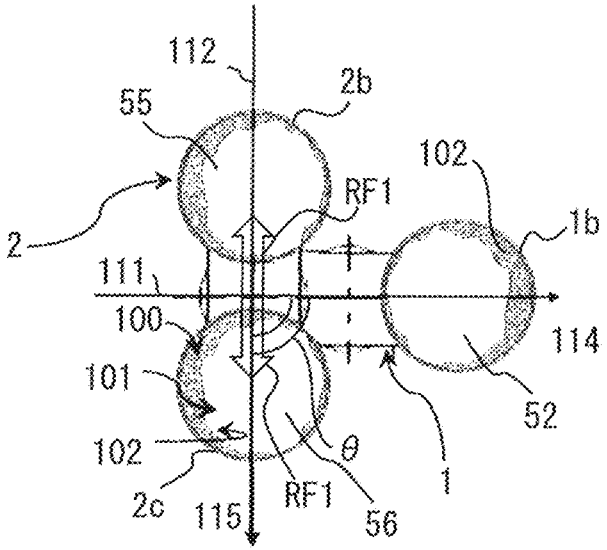
FIG. 12 is a schematic sectional view taken along line G-G in the trifurcate distributor in FIG. 6.

FIG. 12 is a schematic sectional view taken along line G-G in the trifurcate distributor 10 in FIG. 6. As shown in FIG. 6, the refrigerant flowing to the connection pipe 20 rises upward in a direction opposite to the gravity direction in the connection pipe 20 connecting to the second bifurcate flow divider 2, and flows into the second bifurcate flow divider 2 from the inflow port 54. As shown in FIG. 12, the refrigerant flowing into the second bifurcate flow divider 2 is distributed in a direction parallel with the plane 112, in the second bifurcate flow divider 2. An arrow RF1 shown in FIG. 12 represents a direction in which the refrigerant flowing into the second bifurcate flow divider 2 from the first bifurcate flow divider 1 flows. Note that the direction parallel with the plane 112 is a direction that is substantially perpendicular to the direction in which the liquid refrigerant 100 in the first bifurcate flow divider 1 is biased. Subsequently, the refrigerant flowing into the second bifurcate flow divider 2 flows to the second outdoor heat exchanger 12 from the outflow port 55, and flows to the third outdoor heat exchanger 13 from the outflow port 53.

Figure 13:
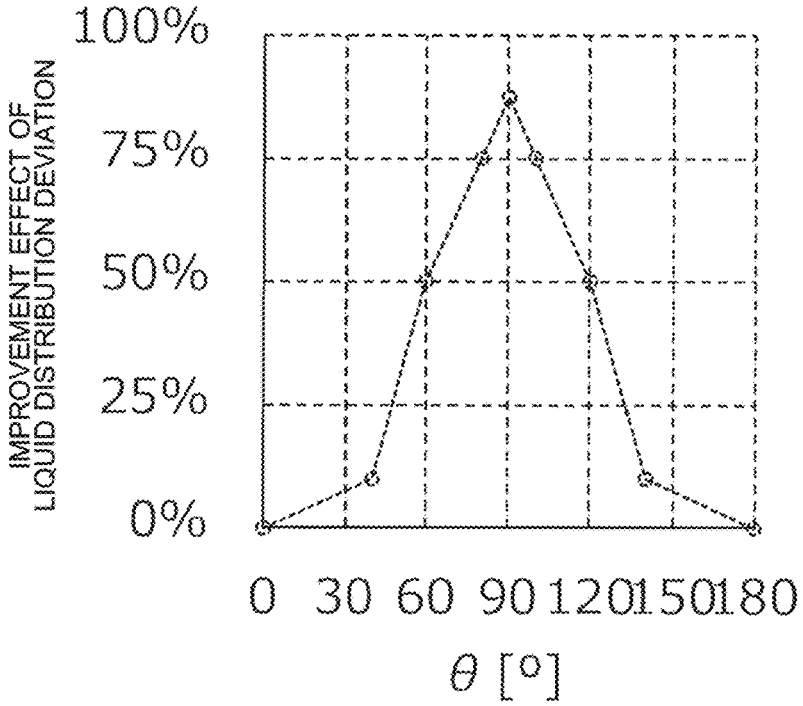
FIG. 13 is a diagram showing a relationship between an angle θ and an improvement effect of a liquid distribution deviation, in the trifurcate distributor according to Embodiment 1 of the present invention.

FIG. 13 is a diagram showing a relationship between the angle θ and an improvement effect of a liquid distribution deviation in the trifurcate distributor 10 according to Embodiment 1 of the present invention. FIG. 13 represents a result that the relationship between the angle θ and the improvement effect of the liquid distribution deviation is investigated in a condition range of a mass velocity of the inflow refrigerant of 260 to 2145 kg/m^2 s, and a quality of 0.05 to 0.60 in the trifurcate distributor 10. The test of the inventors has shown that the improvement effect of the liquid distribution deviation of the trifurcate distributor 10 is obtained by specifying the angle θ between the plane 111 and the plane 112 to 60 degrees or more and 120 degrees or less as shown in FIG. 13. Furthermore, as shown in FIG. 13, the test of the inventors has shown that the improvement effect of the liquid distribution deviation of the trifurcate distributor 10 is further obtained by specifying the angle θ between the plane 111 and the plane 112 to 80 degrees or more and 100 degrees or less. The liquid distribution deviation is defined as follows. (Liquid distribution deviation)=|(1−(quality of refrigerant flowing in the outflow port 52, the outflow port 55, or the outflow port 56 of the trifurcate distributor 10))/(1−(quality of refrigerant flowing in the inflow port 51))|−1. Furthermore, the improvement effect in FIG. 13 is shown in a case of an angle θ=0 degrees.

The refrigerant exchanging heat with air in the first outdoor heat exchanger 11, the refrigerant exchanging heat with air in the second outdoor heat exchanger 12, and the refrigerant exchanging heat with air in the third outdoor heat exchanger 13 merges in a third bifurcate flow divider 3 and a fourth bifurcate flow divider 4 located downstream of the first outdoor heat exchanger 11, the second outdoor heat exchanger 12, and the third outdoor heat exchanger 13, and flows to an inlet port of the compressor 14 through the flow switching device 15. The refrigerant flowing into the compressor 14 is compressed to be gas refrigerant with a high temperature and a high pressure, and flows to the indoor heat exchanger 16 again via the flow switching device 15. Note that the third bifurcate flow divider 3 and the fourth bifurcate flow divider 4 located downstream are each used as a merger in which the refrigerant flowing in from the two branch pipes merges to flow out from one pipe.

Next, the operation of the air-conditioning apparatus 200 according to Embodiment 1 will be described with a cooling operation as an example. As shown in FIG. 1, the gas refrigerant compressed by the compressor 14 and superheated to a high temperature and a high pressure flows into the first outdoor heat exchanger 11, the second outdoor heat exchanger 12, and the third outdoor heat exchanger 13 through the flow switching device 15, and the third bifurcate flow divider 3 and the fourth bifurcate flow divider 4. The refrigerant flowing in the first outdoor heat exchanger 11, the second outdoor heat exchanger 12, and the third outdoor heat exchanger 13 exchanges heat with air, is subcooled to be liquid refrigerant and flows out from the heat exchangers. The refrigerant flowing out from the first outdoor heat exchanger 11, the second outdoor heat exchanger 12, and the third outdoor heat exchanger 13 merges in the second bifurcate flow divider 2 and first bifurcate flow divider 1 located downstream of the first outdoor heat exchanger 11, the second outdoor heat exchanger 12, and the third outdoor heat exchanger 13, and is decompressed by the decompressing device 17 to be two-phase gas-liquid refrigerant. Subsequently, the two-phase gas-liquid refrigerant receives heat from indoor air in the indoor heat exchanger 16, and flows in the compressor 14 through the flow switching device 15. The refrigerant flowing in the compressor 14 is compressed in the compressor 14 again to be gas refrigerant superheated to a high temperature and a high pressure. The gas refrigerant flows in the first outdoor heat exchanger 11, the second outdoor heat exchanger 12, and the third outdoor heat exchanger 13 through the flow switching device 15, the third bifurcate flow divider 3, and the fourth bifurcate flow divider 4.

As above, in the trifurcate distributor 10, the angle θ formed by the plane 111 passing through the center points of the one inflow port 51 and the two outflow port 52 and outflow port 53 of the first bifurcate flow divider 1, and the plane 112 passing through the center points of the one inflow port 54 and the two outflow port 55 and outflow port 56 of the second bifurcate flow divider 2 is 60 degrees or more and 120 degrees or less. In other words, in the trifurcate distributor 10, the plane 112 in the two branch directions of the second bifurcate flow divider 2 is at the angle of 60 degrees or more and 120 degrees or less to the plane 111 in the biased direction of the liquid refrigerant in the outflow port of the first bifurcate flow divider 1. For example, when the plane 111 and the plane 112 of the trifurcate distributor are substantially parallel with each other, a large amount of liquid refrigerant biased by a centrifugal force in the first bifurcate flow divider 1 may flow in one passage of the second bifurcate flow divider 2. As the trifurcate distributor 10 includes the above described configuration, a direction of a centrifugal force acting on the liquid refrigerant in the second bifurcate flow divider 2 differs from a direction of a centrifugal force acting on the liquid refrigerant in the first bifurcate flow divider 1. Consequently, the liquid refrigerant distributed by being biased by the centrifugal force in the outflow port 53 of the first bifurcate flow divider 1 can be distributed without being biased to one passage of the fifth pipe portion 2*b* or the sixth pipe portion 2*c* in a branch portion of the second bifurcate flow divider 2. As a result, reduction in distribution performance of the two-phase gas-liquid refrigerant in the second bifurcate flow divider 2 due to a bias of the liquid refrigerant in the outflow port 53 of the first bifurcate flow divider 1 can be reduced. Furthermore, as the air-conditioning apparatus 200 includes the trifurcate distributor 10, the air-conditioning apparatus 200 can reduce reduction in distribution performance of the two-phase gas-liquid refrigerant, and can decrease a deviation of the liquid distribution amount of the two-phase refrigerant supplied to the three outdoor heat exchangers 30. As a result, the air-conditioning apparatus 200 can enhance heat exchange performance of the outdoor heat exchangers 30, and can enhance energy saving performance. Furthermore, the trifurcate distributor 10 enables more even two-phase gas-liquid distribution by disposing the first bifurcate flow divider 1 and the second bifurcate flow divider 2 in such a manner that the angle θ between the plane 111 and the plane 112 is 80 degrees or more and 100 degrees or less. Consequently, the air-conditioning apparatus 200 can enhance the heat exchange performance of the outdoor heat exchangers 30.

Embodiment 2

Figure 14:
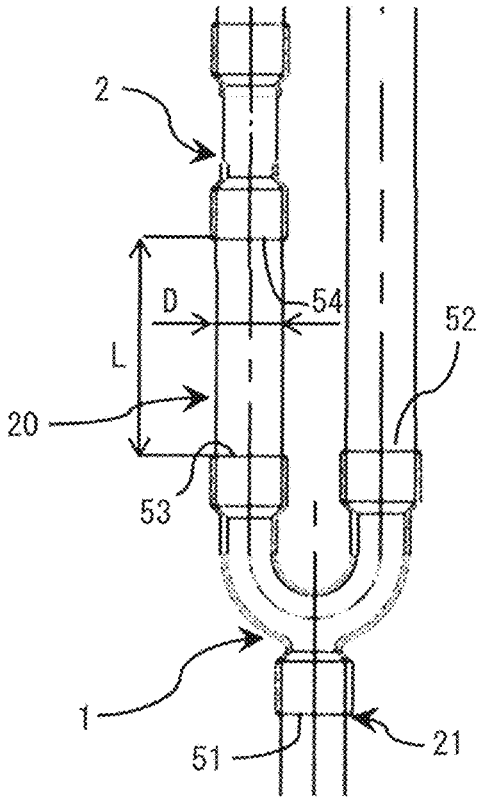
FIG. 14 is a schematic front view showing a dimensional definition of a trifurcate distributor according to Embodiment 2 of the present invention.

FIG. 14 is a schematic front view showing a dimensional definition of a trifurcate distributor 10 according to Embodiment 2 of the present invention. The trifurcate distributor 10 of Embodiment 2 of the present invention is to refer to a shape of the connection pipe 20 included in the trifurcate distributor 10 of Embodiment 1, and configurations of the trifurcate distributor 10 and an air-conditioning apparatus 200 are the same as the configurations of the trifurcate distributor 10 and the air-conditioning apparatus 200 of Embodiment 1. Consequently, parts having the same configurations as the configurations of the trifurcate distributor 10 and the air-conditioning apparatus 200 in FIG. 1 to FIG. 13 are assigned with the same reference signs and explanation of the parts is omitted. In the trifurcate distributor 10 according to Embodiment 2, in a case where a length of a connection pipe 20 vertically upward that connects to an inflow port 54 of a second bifurcate flow divider 2 is specified as a length L, and an inside diameter of the connection pipe 20 is specified as an inside diameter D, the length L of the connection pipe 20 is specified to 5D or more and 20D or less. In other words, the length L of a linear part of the connection pipe 20 extending downward from a fourth pipe portion 2*a* is a length of 5D or more and 20D or less, where the inside diameter D of the connection pipe 20 is a unit.

Figure 15:
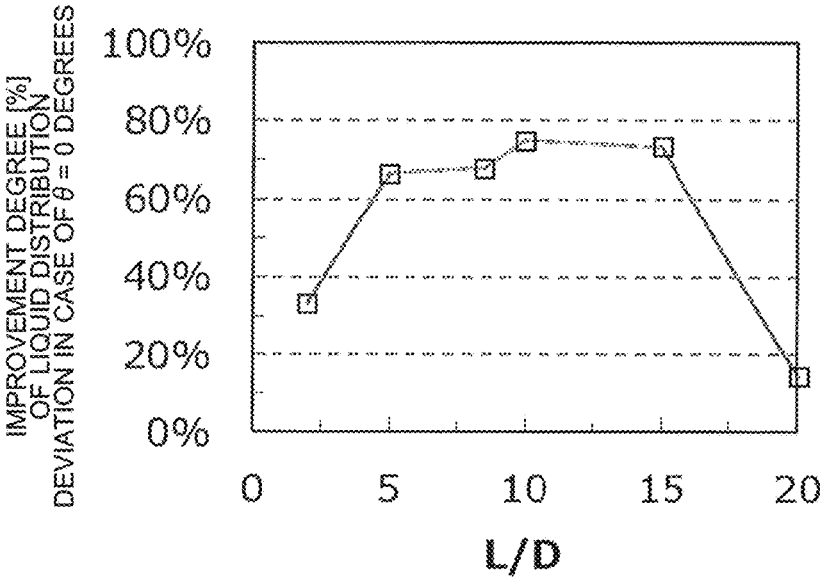
FIG. 15 is a diagram showing a relationship between a length L/inside diameter D of a connection pipe, and an improvement degree of a liquid distribution deviation in a case of an angle θ=0 degrees, in the trifurcate distributor according to Embodiment 2 of the present invention.

FIG. 15 is a diagram showing a relationship between the length L/inside diameter D of the connection pipe 20 and an improvement degree of a liquid distribution deviation in a case of the angle θ=0 degrees, in the trifurcate distributor 10 according to Embodiment 2 of the present invention. The connection pipe 20 is formed in such a manner that the length L is a length of 5D or more to ensure a run-up distance. As the connection pipe 20 is formed in this manner, the trifurcate distributor 10 can reduce reduction in performance of two-phase distribution caused by liquid refrigerant colliding with a pipe inner wall surface of the second bifurcate flow divider 2 and flowing back to a first bifurcate flow divider 1, as shown in FIG. 15. Furthermore, a gas-liquid interface disturbed by flow division by the first bifurcate flow divider 1 becomes an annular flow again by ensuring the run-up distance in the connection pipe 20. Consequently, the trifurcate distributor 10 can reduce performance reduction of two-phase distribution in the second bifurcate flow divider 2 by distribution of the first bifurcate flow divider 1, and can enhance distribution performance of the trifurcate distributor 10. Furthermore, as the distribution performance of the trifurcate distributor 10 is enhanced, the trifurcate distributor 10 can enhance heat exchange performance of the outdoor heat exchangers 30. Note that where the length L of the connection pipe 20 is specified to 20D or more, a sufficient run-up distance can be ensured in the connection pipe 20 even in a case of the angle θ=0 degrees, and a flow in the pipe disturbed by the flow division of the first bifurcate flow divider 1 increases to decrease liquid distribution deviation, so that an improvement effect of distribution performance decreases.

As above, in the trifurcate distributor 10 according to Embodiment 2, the length L of the linear portion of the connection pipe 20 extending downward from the fourth pipe portion 2*a* is a length of 5D or more and 20D or less, where the inside diameter D of the connection pipe 20 is a unit. In the trifurcate distributor 10, the length L of the connection pipe 20 is specified to 5D or more to ensure the run-up distance. Consequently, the trifurcate distributor 10 can reduce reduction in performance of two-phase distribution, caused by the liquid refrigerant colliding with the pipe inner wall surface of the second bifurcate flow divider 2 and flowing back to the first bifurcate flow divider 1. Furthermore, in the trifurcate distributor 10, the gas-liquid interface disturbed by flow division of the first bifurcate flow divider 1 becomes an annular flow again by ensuring the run-up distance in the connection pipe 20. Consequently, the trifurcate distributor 10 can reduce performance reduction of two-phase distribution in the second bifurcate flow divider 2 due to distribution of the first bifurcate flow divider 1, and can enhance distribution performance of the trifurcate distributor 10. Furthermore, as the distribution performance of the trifurcate distributor 10 is enhanced, the trifurcate distributor 10 can enhance the heat exchange performance of the outdoor heat exchangers 30. Furthermore, as the length L of the connection pipe 20 is specified to 20D or less, the air-conditioning apparatus 200 can improve space efficiency in a casing 201A of the outdoor unit 201, and reduce component cost.

Embodiment 3

Figure 16:
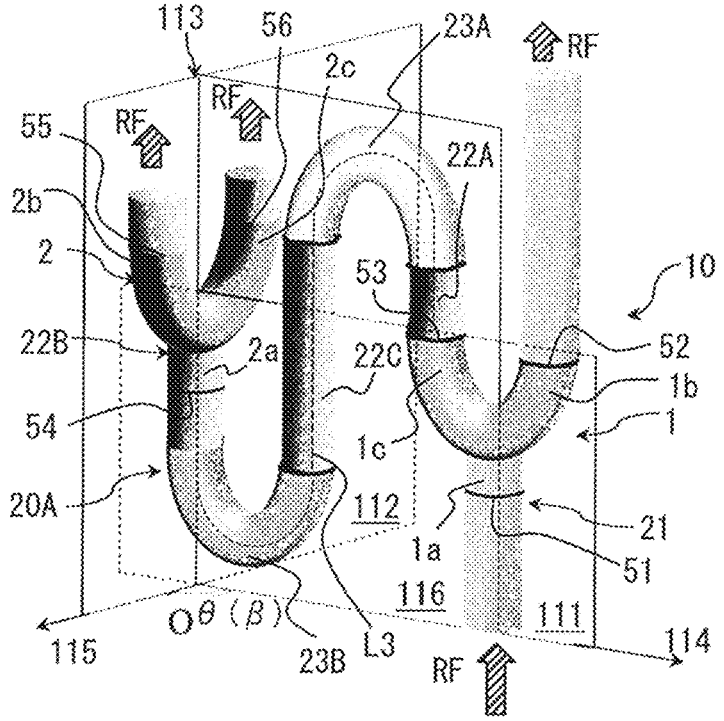
FIG. 16 is a perspective view of a trifurcate distributor according to Embodiment 3 of the present invention.
Figure 17:
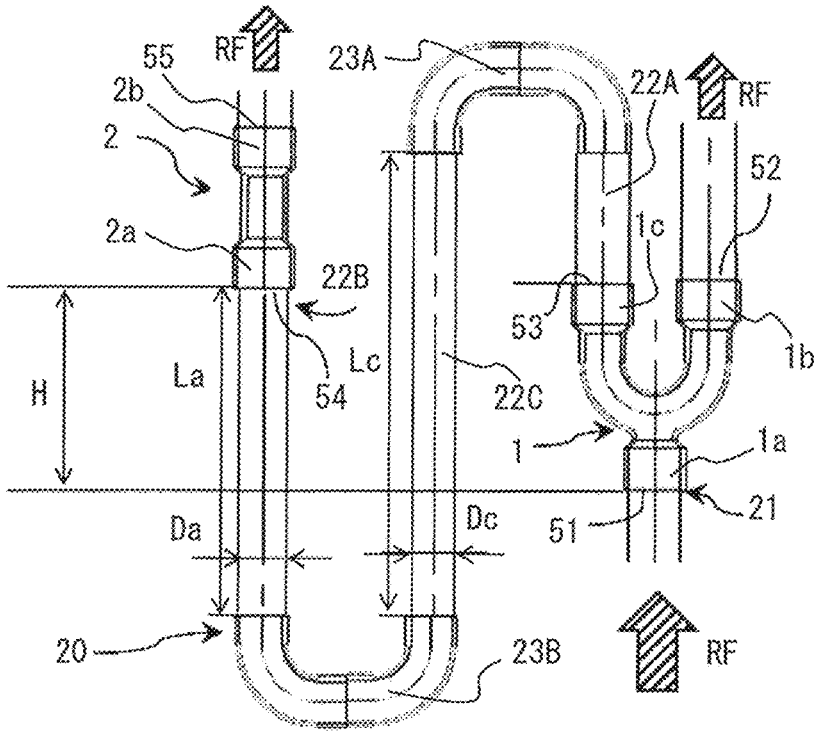
FIG. 17 is a schematic front view of the trifurcate distributor according to Embodiment 3 of the present invention.

FIG. 16 is a perspective view of a trifurcate distributor 10 according to Embodiment 3 of the present invention. FIG. 17 is a schematic front view of the trifurcate distributor 10 according to Embodiment 3 of the present invention. The trifurcate distributor 10 according to Embodiment 3 of the present invention is formed in such a manner that a shape of the connection pipe 20 included in the trifurcate distributor 10 of Embodiment 1 is changed, but other configurations of the trifurcate distributor 10 and the air-conditioning apparatus 200 are the same as the configurations in Embodiment 1 or 2. Consequently, parts having the same configurations as the configurations of the trifurcate distributor 10 and the air-conditioning apparatus 200 in FIG. 1 to FIG. 15 are assigned with the same reference signs and explanation of the parts is omitted.

In the trifurcate distributor 10 according to Embodiment 3, a connection pipe 20A having a plurality of bending portions is connected to between a first bifurcate flow divider 1 and a second bifurcate flow divider 2. As shown in FIG. 16, the connection pipe 20A has an upper end connecting to a fourth pipe portion 2*a* vertically upward, and a lower end connecting to a third pipe portion 1*c*. As shown in FIG. 16, the connection pipe 20A is a pipe circular in section, and has at least one first curved pipe portion 23A that turns from upward to downward in a direction of gravity, and at least one second curved pipe portion 23B that turns from downward to upward in the direction of gravity. Furthermore, the connection pipe 20A has a first straight pipe portion 22A located between the first bifurcate flow divider 1 and the first curved pipe portion 23A and connecting to the third pipe portion 1*c*, and a second straight pipe portion 22B located between the second bifurcate flow divider 2 and the second curved pipe portion 23B and connecting to the fourth pipe portion 2*a*. The second straight pipe portion 22B extends in the vertical direction as shown in FIG. 16 and FIG. 17. Furthermore, the connection pipe 20A has a third straight pipe portion 22C disposed between the first curved pipe portion 23A and the second curved pipe portion 238, and having a lower end connecting to the second curved pipe portion 23B. The third straight pipe portion 22C extends in the vertical direction in FIG. 17, but both end portions are only required to be located in an up-down direction, and the third straight pipe portion 22C may be disposed by being tilted. The first straight pipe portion 22A, the second straight pipe portion 22B, and the third straight pipe portion 22C are straight-line portions of a pipeline in the connection pipe 20A. When a plurality of first curved pipe portions 23A or second curved pipe portions 23B are present, a plurality of other straight pipe portions are each disposed between the corresponding ones of the first curved pipe portions 23A and the second curved pipe portions 23B. Furthermore, to constitute the connection pipe 20A, the first curved pipe portion 23A, the second curved pipe portion 238, the first straight pipe portion 22A, the second straight pipe portion 228, and the third straight pipe portion 22C may be formed integrally, or may be individual pipe portions and combined with each other.

A center line of the connection pipe 20A is located on a plane 111 as shown in FIG. 16. Note that the connection pipe 20A is not limited to the connection pipe of which the center line is located on the plane 111. For example, in the connection pipe 20A, as long as a center line of the first straight pipe portion 22A is located on the plane 111, and a center line of the second straight pipe portion 22B is located on a plane 112, the center line of the second straight pipe portion 22B does not have to be located on the plane 111.

As shown in FIG. 17, when a distance in the vertical direction between an inflow port 51 and an inflow port 54 is specified as a distance H, and an inside diameter of the connection pipe 20A is specified as an inside diameter Da in the connection pipe 20A, the distance H is desirably specified at −5 Da or more and 5 Da or less. When the distance H is specified at −5 Da or more and 5 Da or less in the trifurcate distributor 10, a difference in potential energy of refrigerant between the first bifurcate flow divider 1 and the second bifurcate flow divider 2 decreases relatively to kinetic energy of the refrigerant. Consequently, even when a refrigerant flow rate is small, and the kinetic energy of the refrigerant is small in a heating intermediate load operation or other similar operation, distribution performance is not reduced in the trifurcate distributor 10.

Where a length of the second straight pipe portion 22B of the connection pipe 20A connecting vertically upward to the inflow port 54 of the second bifurcate flow divider 2 is specified as La, and an inside diameter of the connection pipe 20A is specified as Da in the trifurcate distributor 10, the length La of the second straight pipe portion 22B of the connection pipe 20A is specified to 5 Da or more and 20 Da or less. In other words, in the second straight pipe portion 22B of the connection pipe 20A, the length La of the pipe of the second straight pipe portion 22B extending downward from the fourth pipe portion 2*a* is a length of 5 Da or more and 20 Da or less, where the inside diameter Da of the second straight pipe portion 22B is a unit.

In the trifurcate distributor 10 according to Embodiment 3, a plane where a center line L3 of the connection pipe 20A shown in FIG. 16 passes is referred to as a plane 116. In the trifurcate distributor 10 according to Embodiment 3, an angle RI formed by the plane 116 passing through the center line of the connection pipe 20A and the plane 112 is an angle of 60 degrees or more and 120 degrees or less. Furthermore, in the third straight pipe portion 22C connected to the second straight pipe portion 22B via the second curved pipe portion 23B, shown in FIG. 7, a length Lc of the third straight pipe portion 22C is a length of 10Dc or more and 20Dc or less, where an inside diameter Dc of the third straight pipe portion 22C is a unit. Note that the plane 116 corresponds to a "third plane" of the present invention.

Figure 18:
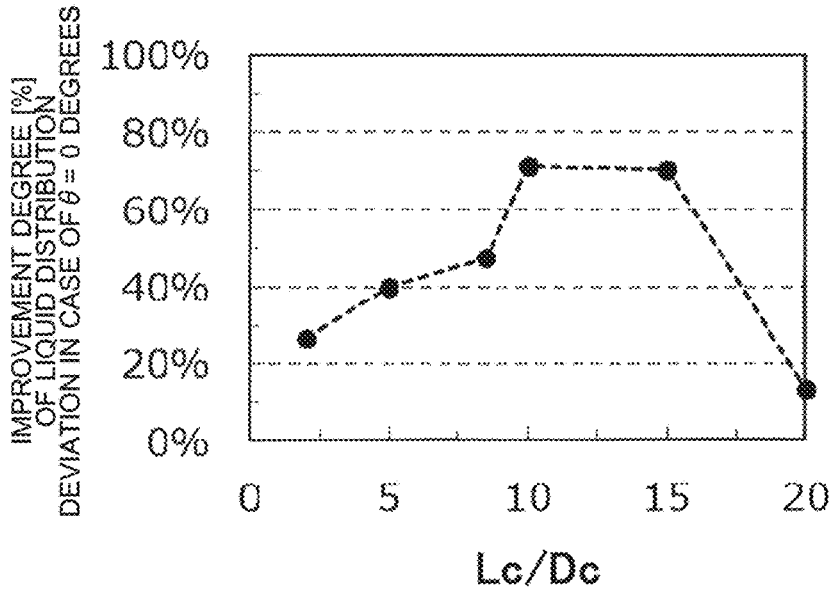
FIG. 18 is a diagram showing a relationship between a length Lc/inside diameter Dc of a connection pipe, and an improvement degree of a liquid distribution deviation in a case of an angle θ=0 degrees, in the trifurcate distributor according to Embodiment 3 of the present invention.

FIG. 18 is a diagram showing a relationship between the length Lc/inside diameter Dc of the connection pipe 20A and an improvement degree of a liquid distribution deviation in a case of the angle θ=0 degrees, in the trifurcate distributor 10 according to Embodiment 3 of the present invention. As shown in FIG. 18, in the connection pipe 20A, the length Lc of the third straight pipe portion 22C is specified to 10Dc or more to ensure a run-up distance. This configuration enables the refrigerant flows in the second curved pipe portion 23B with an increased flow, and therefore the improvement degree of the liquid distribution deviation in a case of the angle θ=0 degrees increases. Where the length Lc of the third straight pipe portion 22C is specified to 20Dc or more, a sufficient run-up distance can be ensured in the connection pipe 20A even in a case of the angle θ=0 degrees, and the flow in the pipe disturbed by flow division in the second bifurcate flow divider 2 increases to decrease the liquid distribution deviation, so that the improvement effect of distribution performance decreases.

As above, in the trifurcate distributor 10 according to Embodiment 3 of the present invention, the connection pipe 20A having a plurality of bending portions is connected to between the first bifurcate flow divider 1 and the second bifurcate flow divider 2. Consequently, the trifurcate distributor 10 can reduce reduction in performance of two-phase distribution in the first bifurcate flow divider 1, caused by the liquid refrigerant colliding with the pipe inner wall surface of the second bifurcate flow divider 2 and flowing back to the first bifurcate flow divider 1. Furthermore, the trifurcate distributor 10 can reduce reduction in performance of two-phase distribution in the second bifurcate flow divider 2, caused by the refrigerant flowing in the second bifurcate flow divider 2 being unable to form an annular flow due to a gas-liquid interface disturbed by flow division in the first bifurcate flow divider 1. As a result, in the air-conditioning apparatus 200, the distribution performance of the trifurcate distributor 10 is enhanced, and heat exchange performance of the outdoor heat exchangers 30 is enhanced, accordingly. Furthermore, in the air-conditioning apparatus 200, the degree of freedom of installation in a height direction of the second bifurcate flow divider 2 is increased, and for example, the second bifurcate flow divider 2 can be installed at the same vertical height as a vertical height of the first bifurcate flow divider 1. Consequently, the air-conditioning apparatus 200 does not need to increase a size of a casing 201A of the outdoor unit 201 to install the trifurcate distributor 10, can reduce the size of the casing 201A, and can reduce cost associated with an increase in size of the casing 201A.

Furthermore, in the trifurcate distributor 10 according to Embodiment 3, the length La of the pipe of the second straight pipe portion 22B extending downward from the fourth pipe portion 2*a* is a length of 5 Da or more and 20 Da or less, where the inside diameter Da of the second straight pipe portion 22B is a unit. In the trifurcate distributor 10, the length La of the second straight pipe portion 22B is specified to 5 Da or more to ensure a run-up distance. Consequently, the trifurcate distributor 10 can reduce reduction in performance of two-phase distribution, caused by the liquid refrigerant colliding with the pipe inner wall surface of the second bifurcate flow divider 2 and flowing back to the first bifurcate flow divider 1. Furthermore, in the trifurcate distributor 10, the gas-liquid interface disturbed by flow division in the first bifurcate flow divider 1 becomes an annular flow again by ensuring the run-up distance in the second straight pipe portion 22B. Consequently, the trifurcate distributor 10 can reduce reduction in performance of two-phase distribution in the second bifurcate flow divider 2 due to distribution of the first bifurcate flow divider 1, and can enhance distribution performance of the trifurcate distributor 10. Furthermore, as distribution performance of the trifurcate distributor 10 is enhanced, the air-conditioning apparatus 200 can enhance heat exchange performance of the outdoor heat exchangers 30. Furthermore, the length La of the second straight pipe portion 22B of the connection pipe 20 is specified to 20 Da or less, the air-conditioning apparatus 200 can improve space efficiency in the casing 201A of the outdoor unit 201 and reduce component cost.

Furthermore, in the trifurcate distributor 10 according to Embodiment 3, the length Lc of the third straight pipe portion 22C is a length of 10Dc or more and 20Dc or less, where the inside diameter Dc of the third straight pipe portion 22C is a unit. As the length Lc of the third straight pipe portion 22C is specified to ensure the run-up distance of 10Dc or more in the connection pipe 20A, the refrigerant flows in the second curved pipe portion 23B with an increased flow, and therefore the improvement degree of the liquid distribution deviation in a case of the angle θ=0 degrees increases. Furthermore, when the angle formed by the two planes that are the plane 112 formed in the branching direction of the second bifurcate flow divider 2, and the plane 116 where the center line L3 of the inlet pipe 21 is located is specified as the angle β, the angle β is the angle of 60 degrees or more and 120 degrees or less. As the trifurcate distributor 10 includes the above described configuration, the direction of the centrifugal force acting on the liquid refrigerant in the second bifurcate flow divider 2 differs from the direction of the centrifugal force acting on the liquid refrigerant in the second curved pipe portion 23B. Consequently, the liquid refrigerant can be distributed in such a manner that the liquid refrigerant distributed by being biased by the centrifugal force in the second curved pipe portion 23B is not biased to one passage of the fifth pipe portion 2*b* or the sixth pipe portion 2*c* in the branch portion of the second bifurcate flow divider 2. Consequently, it is possible to reduce reduction in distribution performance of two-phase gas-liquid distribution of the second bifurcate flow divider 2, caused by a bias of the liquid refrigerant to an outer circumference of the bending portion caused from difference of centrifugal forces acting on gas-phase refrigerant and liquid-phase refrigerant in the second curved pipe portion 238, due to a density difference between the gas-phase refrigerant and the liquid-phase refrigerant. Furthermore, the air-conditioning apparatus 200 includes the trifurcate distributor 10 of the above described configuration, and thereby can decrease a distribution deviation of the liquid refrigerant by adjusting two-phase gas-liquid distribution to the three outdoor heat exchangers 30. As a result, the air-conditioning apparatus 200 enhances heat exchange performance of the outdoor heat exchangers 30, and can enhance energy saving performance.

Furthermore, as the first bifurcate flow divider 1 and the second bifurcate flow divider 2 are disposed in such a manner that the angle θ between the plane 111 and the plane 112 is 80 degrees or more and 100 degrees or less in the trifurcate distributor 10 according to Embodiment 3, more even two-phase gas-liquid distribution is enabled. As a result, distribution performance of the trifurcate distributor 10 is enhanced, and thereby the air-conditioning apparatus 200 can enhance heat exchange performance of the outdoor heat exchangers 30, and can enhance energy saving performance. Furthermore, in the air-conditioning apparatus 200, as the length Lc of the third straight pipe portion 22C is specified to 20Dc or less, the casing 201A of the outdoor unit 201 does not have to be increased in size to install the trifurcate distributor 10, and the casing 201A can be reduced in size. Consequently, the air-conditioning apparatus 200 can reduce cost associated with an increase in size of the casing 201A.

Embodiment 4

Figure 19:
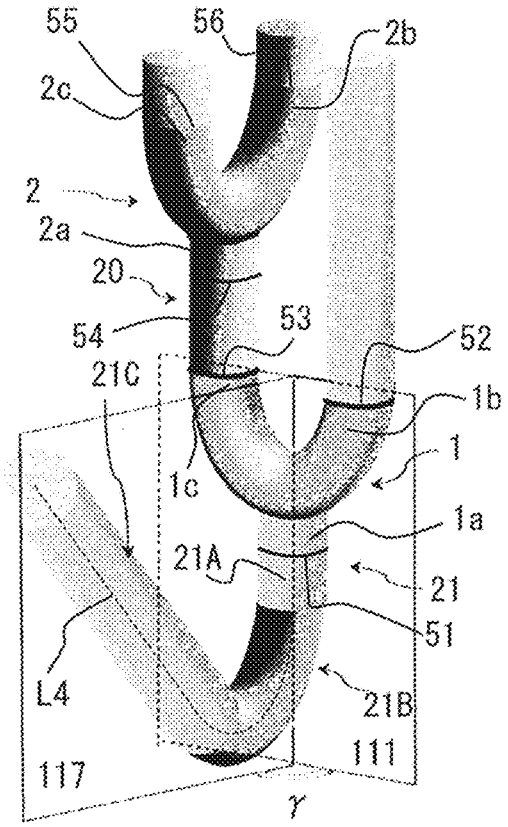
FIG. 19 is a perspective view of a trifurcate distributor according to Embodiment 4 of the present invention.
Figure 20:
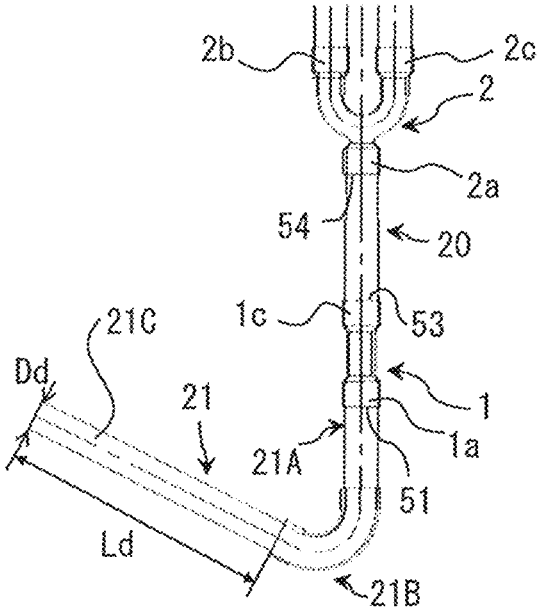
FIG. 20 is a schematic side view of the trifurcate distributor according to Embodiment 4 of the present invention.

FIG. 19 is a perspective view of a trifurcate distributor 10 according to Embodiment 4 of the present invention. FIG. 20 is a schematic side view of the trifurcate distributor 10 according to Embodiment 4 of the present invention. Note that FIG. 20 omits illustration of the second pipe portion 1*b* to express a positional relationship between a first bifurcate flow divider 1 and a second bifurcate flow divider 2. The trifurcate distributor 10 according to Embodiment 4 of the present invention is formed in such a manner that the shape of the inlet pipe 21 included in the trifurcate distributor 10 of Embodiment 1 is changed, and other configurations of the trifurcate distributor 10 and the air-conditioning apparatus 200 are the same as the configurations of Embodiments 1 to 3. Consequently, parts having the same configurations as the trifurcate distributor 10 and the air-conditioning apparatus 200 in FIG. 1 to FIG. 18 are assigned with the same reference signs and explanation of the parts is omitted.

The trifurcate distributor 10 according to Embodiment 4 has an inlet pipe 21 circular in section. The inlet pipe 21 of the trifurcate distributor 10 according to Embodiment 4 is a bent pipe, and has an inlet straight pipe portion 21A, a bent portion 21B, and a straight pipe portion 21C. The inlet straight pipe portion 21A is a portion having an upper end portion connected to a first pipe portion 1*a* vertically upward, and extending in an up-down direction. The bent portion 21B is a portion located between the inlet straight pipe portion 21A and the straight pipe portion 21C in the inlet pipe 21. The bent portion 21B is a portion having one end connected to a lower end portion of the inlet straight pipe portion 21A, and the other end connected to one end of the straight pipe portion 21C, and bent in an arc shape in a pipeline of the inlet pipe 21. The straight pipe portion 21C is a portion having one end connected to the other end of the bent portion 21B and forming a linear pipeline. To constitute the inlet pipe 21, the inlet straight pipe portion 21A, the bent portion 21B, and the straight pipe portion 21C may be formed integrally, or may be individual portions and combined with each other.

In the trifurcate distributor 10 according to Embodiment 4, a plane where a center line L4 of the inlet pipe 21 shown in FIG. 19 passes is referred to as a plane 117. In the trifurcate distributor 10 according to Embodiment 4, an angle γ formed by the plane 117 passing through the center line of the inlet pipe 21, and the plane 111 is an angle of 60 degrees or more and 120 degrees or less. Furthermore, in the straight pipe portion 21C shown in FIG. 20, a length Ld of a pipe of the straight pipe portion 21C is a length of 10Dd or more and 20Dd or less, where an inside diameter Dd of the straight pipe portion 21C is a unit. Note that the plane 117 corresponds to a "fourth plane" of the present invention.

Figure 21:
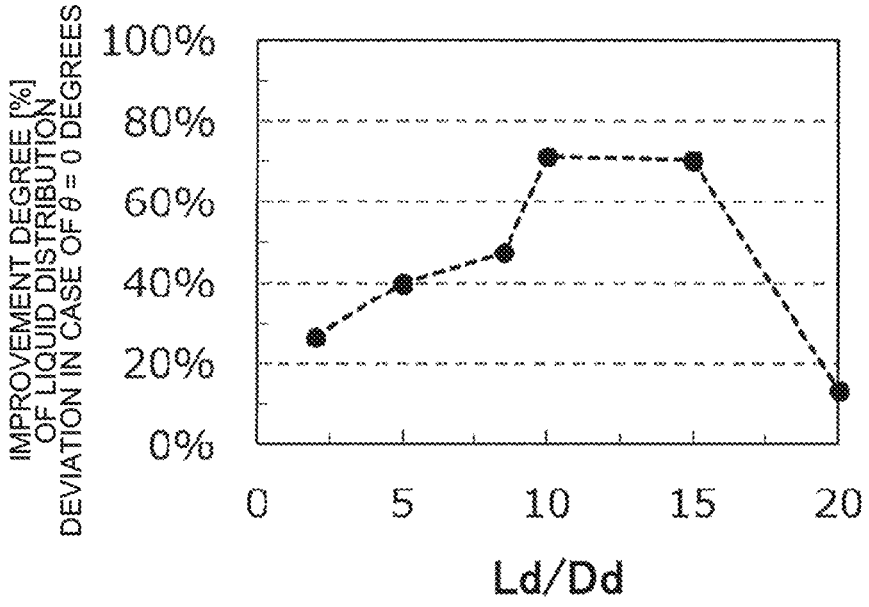
FIG. 21 is a diagram showing a relationship between a length Ld/inside diameter Dd of an inlet pipe, and an improvement degree of a liquid distribution deviation in a case of an angle θ=0 degrees, in the trifurcate distributor according to Embodiment 4 of the present invention.

FIG. 21 is a diagram showing a relationship between the length Ld/inside diameter Dd of the inlet pipe 21, and an improvement degree of a liquid distribution deviation in a case of the angle θ=0 degrees, in the trifurcate distributor 10 according to Embodiment 4 of the present invention. As shown in FIG. 21, in the inlet pipe 21, the length Ld of the pipe of the straight pipe portion 21C is specified to 10Dd or more to ensure a run-up distance. This configuration enables the refrigerant flows in the bent portion 21B with an increased flow, and therefore the improvement degree of a liquid distribution deviation in a case of the angle θ=0 degrees increases. Where the length Ld of the straight pipe portion 21C is specified to 20Dd or more, a sufficient run-up distance can be ensured in the inlet pipe 21 even in a case of θ=0 degrees. Consequently, the flow in the pipe disturbed by flow division in the first bifurcate flow divider 1 increases, the liquid distribution deviation decreases, and an improvement effect of distribution performance decreases.

As above, in the trifurcate distributor 10 according to Embodiment 4, in the straight pipe portion 21C of the inlet pipe 21, the length Ld of the pipe of the straight pipe portion 21C is a length of 10Dd or more and 20Dd or less, where the inside diameter Dd of the straight pipe portion 21C is a unit. As the length Ld of the straight pipe portion 21C is specified to 10Dd or more to ensure a run-up distance in the inlet pipe 21, the refrigerant flows in the bent portion 21B with the increased flow, and therefore, the degree of improvement of a liquid distribution deviation in a case of the angle θ=0 degrees increases. Furthermore, when the angle formed by the two planes that are the plane 111 formed in the branching direction of the first bifurcate flow divider 1 and the plane 117 where the center line L4 of the inlet pipe 21 is located is the angle γ in the trifurcate distributor 10, the angle γ is the angle of 60 degrees or more and 120 degrees or less. As the trifurcate distributor 10 includes the above described configuration, a direction of a centrifugal force acting on the liquid refrigerant in the bent portion 21B differs from a direction of a centrifugal force acting on the liquid refrigerant in the second curved pipe portion 23B. Consequently, the liquid refrigerant can be distributed in such a manner that the liquid refrigerant distributed by being biased by the centrifugal force in the bent portion 21B is not biased to one passage in the fifth pipe portion 2*b* or the sixth pipe portion 2*c* in a branch portion of the second bifurcate flow divider 2. Consequently, it is possible to reduce reduction in distribution performance of two-phase gas-liquid distribution of the first bifurcate flow divider 1, caused by a bias of the liquid refrigerant to an outer circumference of the bending portion that is caused due to difference of the centrifugal forces acting on gas-phase refrigerant and liquid-phase refrigerant in the bent portion 21B due to density difference between the gas-phase refrigerant and the liquid-phase refrigerant. Consequently, in the air-conditioning apparatus 200, two-phase gas-liquid distribution to the three outdoor heat exchangers 30 is adjusted and the distribution deviation of the liquid refrigerant decreases. As a result, the air-conditioning apparatus 200 enhances heat exchange performance of the outdoor heat exchangers 30, and can enhance energy saving performance.

Furthermore, in the trifurcate distributor 10 according to Embodiment 4, the first bifurcate flow divider 1 and the second bifurcate flow divider 2 are disposed in such a manner that the angle θ between the plane 111 and the plane 112 is 80 degrees or more and 100 degrees or less, and more even two-phase gas-liquid distribution is enabled, accordingly. As a result, in the air-conditioning apparatus 200, as the distribution performance of the trifurcate distributor 10 is enhanced, the heat exchange performance of the outdoor heat exchangers 30 can be enhanced, and energy saving performance can be enhanced. Furthermore, in the air-conditioning apparatus 200, as the length Ld of the straight pipe portion 21C is specified to 20Dd or less, the casing 201A of the outdoor unit 201 does not have to be increased in size to install the trifurcate distributor 10, and the casing 201A can be reduced in size. Consequently, the air-conditioning apparatus 200 can reduce cost associated with an increase in size of the casing 201A.

Embodiment 5

Figure 22:
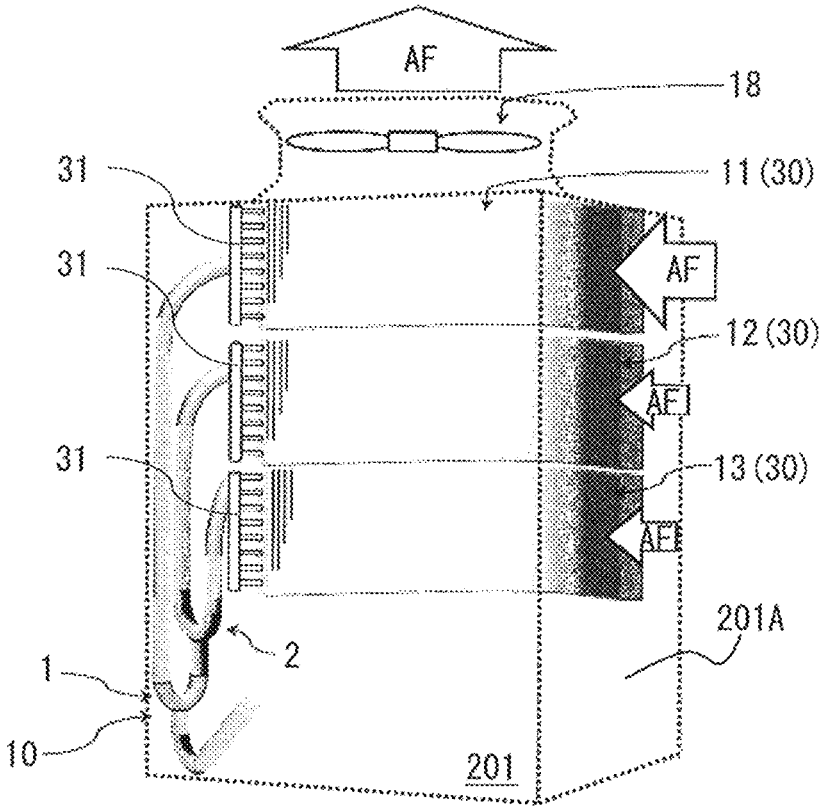
FIG. 22 is a schematic view of an outdoor unit showing a disposition pattern of outdoor heat exchangers in an air-conditioning apparatus according to Embodiment 5 of the present invention.

FIG. 22 is a schematic view of an outdoor unit 201 showing a disposition pattern of outdoor heat exchangers 30 in an air-conditioning apparatus 200 according to Embodiment 5 of the present invention. With the air-conditioning apparatus 200 according to Embodiment 5 of the present invention, the disposition pattern in the outdoor unit 201, of the first outdoor heat exchanger 11, the second outdoor heat exchanger 12, and the third outdoor heat exchanger 13 of the air-conditioning apparatus 200 of Embodiment 1 will be described. Other configurations of the air-conditioning apparatus 200 according to Embodiment 5 are the same as the configurations in Embodiments 1 to 4. Consequently, parts having the same configurations as the configurations of the air-conditioning apparatus 200 in FIG. 1 to FIG. 21 are assigned with the same reference signs, and explanation of the parts is omitted.

An outdoor unit 201 of the air-conditioning apparatus 200 according to Embodiment 5 is of an up-blow outdoor unit in which an air-sending device 18 is provided above the three outdoor heat exchangers 30 that are the first outdoor heat exchanger 11, the second outdoor heat exchanger 12, and the third outdoor heat exchanger 13. The three outdoor heat exchangers 30 that are the first outdoor heat exchanger 11, the second outdoor heat exchanger 12, and the third outdoor heat exchanger 13 are arranged in an up-down direction in the outdoor unit 201. In the outdoor unit 201, the first outdoor heat exchanger 11 connecting to a second pipe portion 1*b* of a first bifurcate flow divider 1 is disposed higher than the second outdoor heat exchanger 12 connecting to a fifth pipe portion 2*b* of a second bifurcate flow divider 2 and the third outdoor heat exchanger 13 connecting to a sixth pipe portion 2*c* of the second bifurcate flow divider 2. Consequently, in the outdoor unit 201, a distance between the first outdoor heat exchanger 11 and the air-sending device 18 is smaller than a distance between the second outdoor heat exchanger 12 and the air-sending device 18, and a distance between the third outdoor heat exchanger 13 and the air-sending device 18. As a result, a larger amount of air by the air-sending device 18 flows to the first outdoor heat exchanger 11 as compared with an amount of air flowing to each of the second outdoor heat exchanger 12 and the third outdoor heat exchanger 13.

Figure 23:
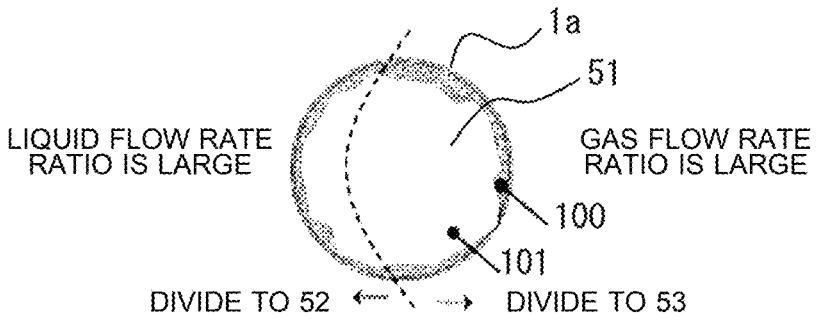
FIG. 23 is a pipe schematic sectional view showing a flow division ratio of refrigerant and a distribution liquid flow rate ratio in a first bifurcate flow divider of the air-conditioning apparatus according to Embodiment 5 of the present invention.
Figure 24:
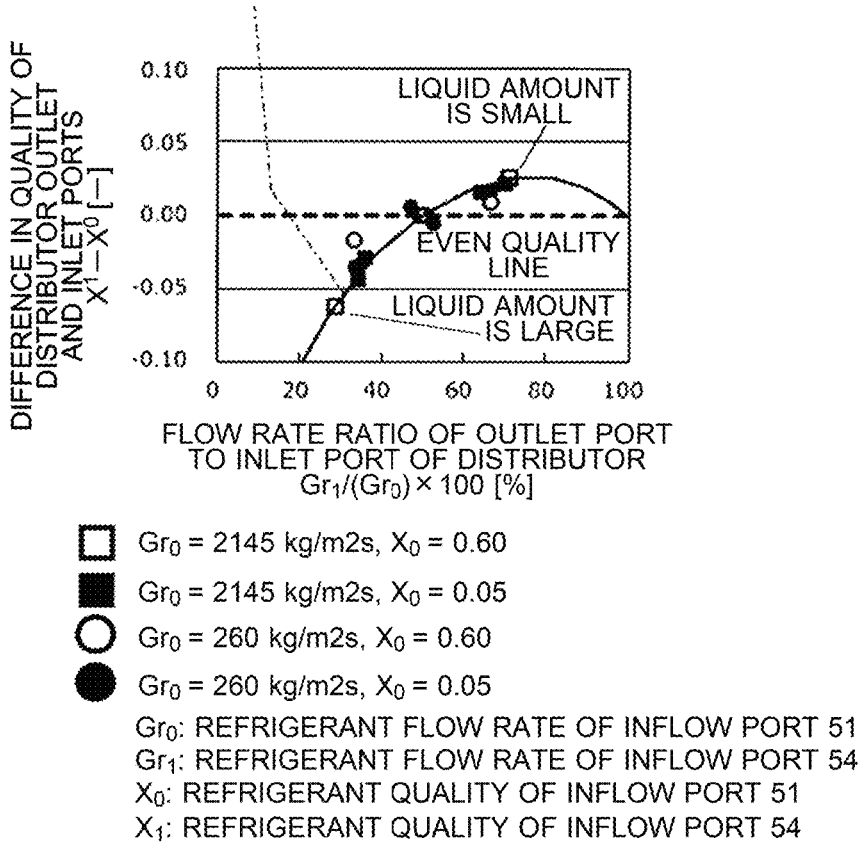
FIG. 24 is a diagram showing the flow division ratio of the refrigerant and the distribution liquid flow rate ratio in the first bifurcate flow divider of the air-conditioning apparatus according to Embodiment 5 of the present invention.

FIG. 23 is a schematic sectional view of a pipe showing a flow division ratio of a refrigerant and a distribution liquid flow rate ratio in the first bifurcate flow divider 1 of the air-conditioning apparatus 200 according to Embodiment 5 of the present invention. FIG. 24 is a diagram showing the flow division ratio of the refrigerant and the distribution liquid flow rate ratio in the first bifurcate flow divider 1 of the air-conditioning apparatus 200 according to Embodiment 5 of the present invention. In the first bifurcate flow divider 1, the one first outdoor heat exchanger 11 is connected downstream of an outflow port 52, and the two outdoor heat exchangers 30 that are the second outdoor heat exchanger 12 and the third outdoor heat exchanger 13 are connected in parallel to each other downstream via the second bifurcate flow divider 2. Consequently, in the first bifurcate flow divider 1, a flow resistance of a passage connected to the outflow port 52 is larger than a flow resistance of a passage connected to the outflow port 53, and as for a refrigerant flow rate ratio of the outflow port 52 and the outflow port 53, the refrigerant flows by being divided at uneven flow rates, as in FIG. 23 and FIG. 24. As shown in FIG. 23, in the inflow port 51 of the first bifurcate flow divider 1, the two-phase gas-liquid refrigerant is in an annular flow, a large amount of liquid is distributed on a wall surface, and the refrigerant in regions close to the outflow ports that are the outflow port 52 and the outflow port 53 flows to the outflow ports. Consequently, more liquid refrigerant flows to the outflow port 52 with a small flow division ratio as compared with a case of even quality distribution. On the other hand, the refrigerant flowing out from the outflow port 53 with less liquid refrigerant as compared with the case of the even quality distribution is distributed at a flow division ratio corresponding to flow resistances of the second outdoor heat exchanger 12 and the third outdoor heat exchanger 13 connecting downstream in the second bifurcate flow divider 2.

As above, in the outdoor unit 201 of the air-conditioning apparatus 200 according to Embodiment 5, more air by the air-sending device 18 flows to the first outdoor heat exchanger 11 as compared with air flowing to each of the second outdoor heat exchanger 12 and the third outdoor heat exchanger 13. In the inflow port 51 of the first bifurcate flow divider 1, the two-phase gas-liquid refrigerant is in an annular flow, a large amount of liquid is distributed on the wall surface, and the refrigerant in the regions close to the outflow ports that are the outflow port 52 and the outflow port 53 flows to the outflow ports. Consequently, more liquid refrigerant flows to the outflow port 52 with a small flow division ratio, as compared with the case of the even quality distribution. On the other hand, the refrigerant flowing out from the outflow port 53 with less liquid refrigerant as compared with the case of the even quality distribution is distributed at flow division ratio corresponding to the flow resistances of the second outdoor heat exchanger 12 and the third outdoor heat exchanger 13 connecting downstream in the second bifurcate flow divider 2. Consequently, a ventilation amount to the first outdoor heat exchanger 11 where a relatively large amount of liquid refrigerant flows increases, so that the heat exchange performance is enhanced, and energy saving performance can be enhanced. In the air-conditioning apparatus 200 of Embodiment 5, sizes and shapes, and the numbers of paths of the outdoor heat exchangers 30 are not limited, but the outdoor heat exchangers 30 are desirably formed in the same shapes to decrease manufacture cost as compared with a case of manufacturing the outdoor heat exchangers 30 in different shapes.

Embodiment 6

Figure 25:
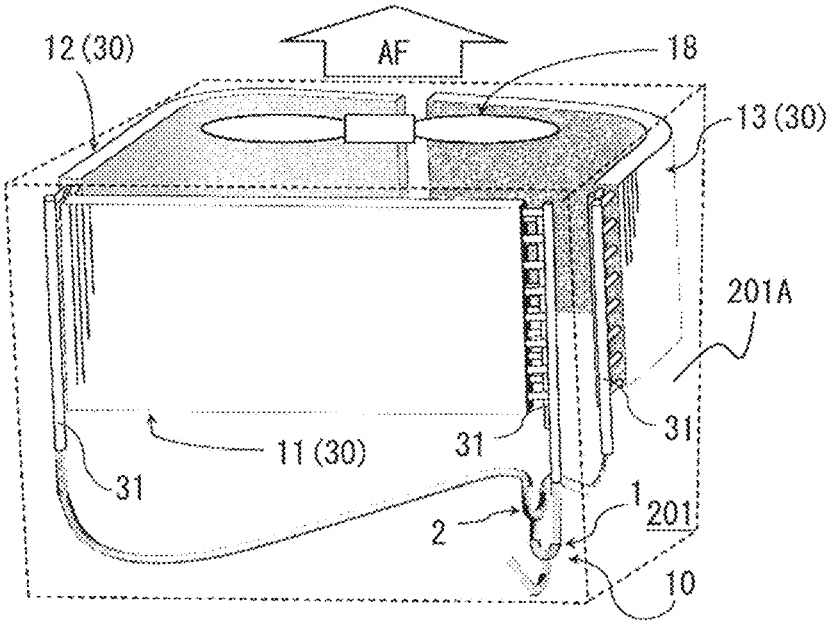
FIG. 25 is a perspective view of an outdoor unit showing a disposition pattern of outdoor heat exchangers in an air-conditioning apparatus according to Embodiment 6 of the present invention.
Figure 26:
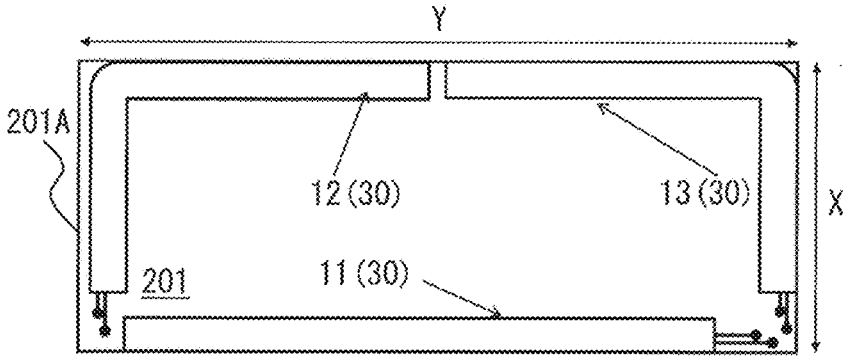
FIG. 26 is a top view showing the disposition pattern of the outdoor heat exchangers in the air-conditioning apparatus according to Embodiment 6 of the present invention.

FIG. 25 is a perspective view of an outdoor unit 201 showing a disposition pattern of outdoor heat exchangers 30 in an air-conditioning apparatus 200 according to Embodiment 6 of the present invention. FIG. 26 is a top view showing a disposition pattern of the outdoor heat exchangers 30 in the air-conditioning apparatus 200 according to Embodiment 6 of the present invention. With the air-conditioning apparatus 200 according to Embodiment 6 of the present invention, the disposition pattern in the outdoor unit 201, of the first outdoor heat exchanger 11, the second outdoor heat exchanger 12, and the third outdoor heat exchanger 13 of the air-conditioning apparatus 200 of Embodiment 1 will be described. Other configurations of the air-conditioning apparatus 200 according to Embodiment 6 are the same as the configurations in Embodiments 1 to 4. Consequently, parts having the same configurations as the configurations of the air-conditioning apparatus 200 in FIG. 1 to FIG. 24 are assigned with the same reference signs and explanation of the parts is omitted.

As shown in FIG. 25, the outdoor unit 201 of the air-conditioning apparatus 200 according to Embodiment 6 is of an up-blow outdoor unit in which an air-sending device 18 is provided above three outdoor heat exchangers 30 that are a first outdoor heat exchanger 11, a second outdoor heat exchanger 12, and a third outdoor heat exchanger 13. In the outdoor unit 201, the three outdoor heat exchangers 30 that are the first outdoor heat exchanger 11, the second outdoor heat exchanger 12, and the third outdoor heat exchanger 13 are arranged in a horizontal direction. In the air-conditioning apparatus 200, the first outdoor heat exchanger 11 is disposed on a side surface extending in a longitudinal direction (Y-axis direction) in plan view. In the air-conditioning apparatus 200, the second outdoor heat exchanger 12 and the third outdoor heat exchanger 13 are each disposed on the corresponding one of parts of a side surface facing the surface on which the first outdoor heat exchanger 11 is disposed, and the corresponding one of side surfaces extending in a short-side direction (X-axis direction). In the outdoor unit 201, a ventilation area of the first outdoor heat exchanger 11 connected to a second pipe portion 1*b* of a first bifurcate flow divider 1 is larger than a ventilation area of the second outdoor heat exchanger 12 connected to the fifth pipe portion 2*b* and than a ventilation area of the third outdoor heat exchanger 13 connected to a sixth pipe portion 2*c*. The ventilation area refers to an area of side surface portions of the outdoor heat exchangers 30 facing toward an outer peripheral surface of a side wall of the casing 201A included in the outdoor unit 201. In other words, the first outdoor heat exchanger 11 has a larger area facing toward the outer peripheral surface of the casing 201A of the outdoor unit 201 that stores the three outdoor heat exchangers 30 than does each of the second outdoor heat exchanger 12 and the third outdoor heat exchanger 13.

As above, in the outdoor unit 201 of the air-conditioning apparatus 200 according to Embodiment 6, the ventilation area of the first outdoor heat exchanger 11 is larger than the ventilation area of the second outdoor heat exchanger 12 and than the ventilation area of the third outdoor heat exchanger 13. Consequently, a relatively large amount of air by the air-sending device 18 flows to the first outdoor heat exchanger 11, as compared with an amount of air flowing to each of the second outdoor heat exchanger 12 and the third outdoor heat exchanger 13. In distribution of the first bifurcate flow divider 1, the two-phase gas-liquid refrigerant in an annular flow is divided at an uneven flow rate as shown in FIG. 23 and FIG. 24. This configuration enables to a large amount of liquid refrigerant to flow to the outflow port 52 with a small distribution ratio as compared with a case of even quality distribution. In the air-conditioning apparatus 200, an increase in refrigerant pressure loss in the pipe is reduced and heat exchange performance can be enhanced by connecting the outflow port 52 where a large amount of liquid refrigerant flows, and the first outdoor heat exchanger 11 with a large ventilation amount. As a result, the air-conditioning apparatus 200 enhances heat exchange performance, and thereby can enhance energy saving performance.

Note that heights in the vertical direction of the outdoor heat exchangers 30 are illustrated to be substantially the same in FIG. 25, but a height in an up-down direction of the first outdoor heat exchanger 11 may be specified higher than heights of the second outdoor heat exchanger 12 and the third outdoor heat exchanger 13 to increase the ventilation area. By configuring the outdoor unit 201 in this manner, a larger amount of air by the air-sending device 18 flows to the first outdoor heat exchanger 11. Consequently, by connecting the outflow port 52 where a large amount of liquid refrigerant flows and the first outdoor heat exchanger 11 with a large ventilation amount, the air-conditioning apparatus 200 reduces an increase in the refrigerant pressure loss in the pipe and can enhance heat exchange performance. As a result, the air-conditioning apparatus 200 is enhanced in heat exchange performance, and therefore can enhance energy saving performance.

Furthermore, when the first outdoor heat exchanger 11 is disposed on one surface extending in the longitudinal direction of the outdoor unit 201, and the second outdoor heat exchanger 12 and the third outdoor heat exchanger 13 are disposed on remaining surfaces as shown in FIG. 26 in the air-conditioning apparatus 200, the first outdoor heat exchanger 11 does not have an L-shaped rectangular portion in plan view. Consequently, in the first outdoor heat exchanger 11, air outside the pipe and the refrigerant in the pipe easily flow, an increase in the refrigerant pressure loss in the pipe is reduced more effectively, and heat exchange performance can be enhanced. As a result, the air-conditioning apparatus 200 is enhanced in heat exchange performance, and can enhance power saving performance.

Figure 27:
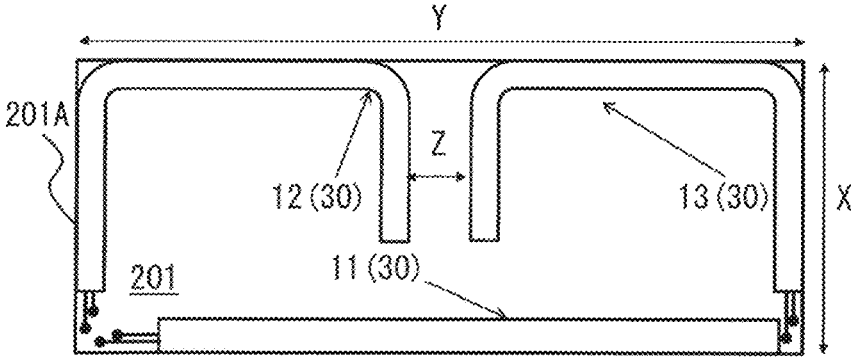
FIG. 27 is a top view showing a modified example of the disposition pattern of the outdoor heat exchangers in the air-conditioning apparatus according to Embodiment 6 of the present invention.

FIG. 27 is a top view showing a modified example of the disposition pattern of the outdoor heat exchangers 30 in the air-conditioning apparatus 200 according to Embodiment 6 of the present invention. The outdoor unit 201 is of an up-blow outdoor unit in which the air-sending device 18 is provided above the three outdoor heat exchangers 30 that are the first outdoor heat exchanger 11, the second outdoor heat exchanger 12, and the third outdoor heat exchanger 13. In the outdoor unit 201, the three outdoor heat exchangers 30 that are the first outdoor heat exchanger 11, the second outdoor heat exchanger 12, and the third outdoor heat exchanger 13 are arranged in a horizontal direction. In the air-conditioning apparatus 200, the first outdoor heat exchanger 11 is disposed on a side surface extending in a longitudinal direction (Y-axis direction) of the casing 201A in plan view. In the air-conditioning apparatus 200, the second outdoor heat exchanger 12 and the third outdoor heat exchanger 13 are disposed on remaining portions of the outer peripheral surface of the casing 201A. In more detail, in the air-conditioning apparatus 200, the second outdoor heat exchanger 12 and the third outdoor heat exchanger 13 are each disposed on the corresponding one of parts of a side surface facing the surface where the first outdoor heat exchanger 11 is disposed, and the corresponding one of side surfaces extending in the short-side direction (X-axis direction) of the casing 201A. In each of the second outdoor heat exchanger 12 and the third outdoor heat exchanger 13, an end portion located opposite to the other end portion where the corresponding one of the distributors 31 is provided extends in an inward direction of the outdoor unit 201 in plan view. In other words, an end portion of the second outdoor heat exchanger 12 and an end portion of the third outdoor heat exchanger 13 facing each other are bent inward of the casing 201A. Consequently, in the outdoor unit 201 of the air-conditioning apparatus 200 according to Embodiment 6, the second outdoor heat exchanger 12 and the third outdoor heat exchanger 13 have ventilation surfaces facing each other at a facing distance Z as parts of the second outdoor heat exchanger 12 and the third outdoor heat exchanger 13. Where a length in the short-side direction of the casing 201A is specified as X, and a length in the longitudinal direction is specified as Y in plan view in the casing 201A of the outdoor unit 201, a ratio Y/X of the lengths of the casing 201A is larger than 2 and is less than 4. Furthermore, the facing distance Z between the second outdoor heat exchanger 12 and the third outdoor heat exchanger 13 is a distance larger than 0 mm and less than or equal to 100 mm. Furthermore, the first outdoor heat exchanger 11, the second outdoor heat exchanger 12, and the third outdoor heat exchanger 13 have the same ventilation areas.

In the air-conditioning apparatus 200 according to Embodiment 6, an aspect ratio Y/X of the casing 201A of the outdoor unit 201 is larger than 2 and is less than 4. Furthermore, in the air-conditioning apparatus 200, the facing distance Z between the second outdoor heat exchanger 12 and the third outdoor heat exchanger 13 is larger than 0 mm and less than or equal to 100 mm. Consequently, the three outdoor heat exchangers 30 having the same ventilation areas are disposed in the configuration, and therefore the air-conditioning apparatus 200 can increase an amount of air flowing to the first outdoor heat exchanger 11 more than an amount of air flowing to the second outdoor heat exchanger 12 and than an amount of air flowing to the third outdoor heat exchanger 13. As a result, the air-conditioning apparatus 200 can deal with air amount loads corresponding to distributions of the liquid refrigerant to the outdoor heat exchangers 30, and therefore is enhanced in heat exchange performance and can enhance energy saving performance.

Embodiment 7

Figure 28:
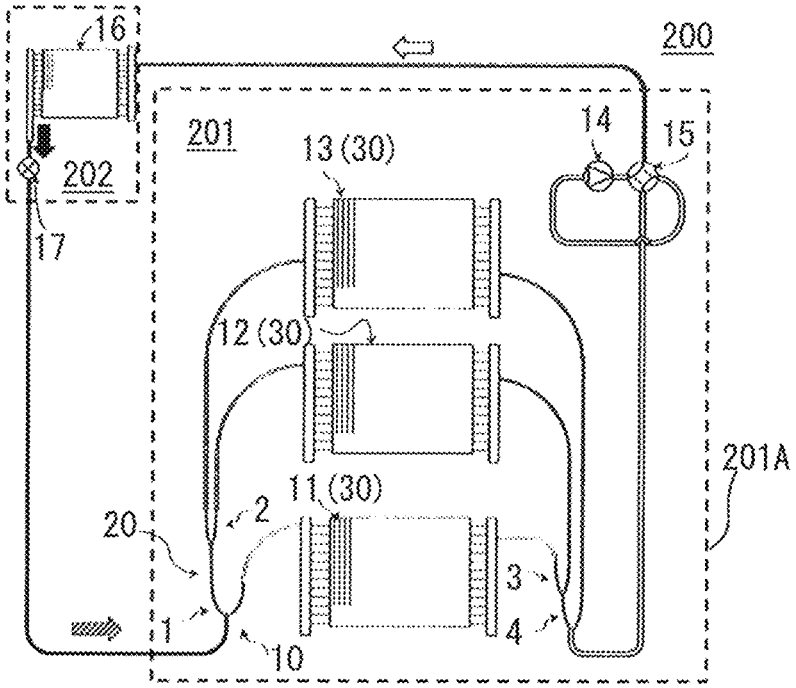
FIG. 28 is a configuration diagram of an air-conditioning apparatus according to Embodiment 7 of the present invention.

FIG. 28 is a configuration diagram of an air-conditioning apparatus 200 according to Embodiment 7 of the present invention. With the air-conditioning apparatus 200 according to Embodiment 7 of the present invention, outlet pipes of the first outdoor heat exchanger 11, the second outdoor heat exchanger 12, and the third outdoor heat exchanger 13 of the air-conditioning apparatus 200 of Embodiment 1 will be described. Other configurations of the air-conditioning apparatus 200 according to Embodiment 7 are the same as the configurations in Embodiments 1 to 6. Consequently, parts having the same configurations as the configurations of the air-conditioning apparatus 200 in FIG. 1 to FIG. 27 are assigned with the same reference signs and explanation of the parts is omitted.

In the air-conditioning apparatus 200 according to Embodiment 7, an outlet port of a first outdoor heat exchanger 11 connecting to a second pipe portion 1*b* of a first bifurcate flow divider 1, and an outlet port of a second outdoor heat exchanger 12 connecting to a fifth pipe portion 2*b* of a second bifurcate flow divider 2 are connected to a third bifurcate flow divider 3. Furthermore, in the air-conditioning apparatus 200 according to Embodiment 7, an outlet port of the third bifurcate flow divider 3, and an outlet port of a third outdoor heat exchanger 13 connecting to a sixth pipe portion 2*c* of the second bifurcate flow divider 2 are connected to a fourth bifurcate flow divider 4. Note that in an outdoor unit 201 of the air-conditioning apparatus 200 according to Embodiment 7, a refrigerant flow rate deviation to the first outdoor heat exchanger 11, the second outdoor heat exchanger 12, and the third outdoor heat exchanger 13 is caused by flow resistance of a connection pipe 20 of a trifurcate distributor 10. The refrigerant flow rate deviation caused in the outdoor unit 201 is further reduced, by connecting the first outdoor heat exchanger 11 to the third bifurcate flow divider 3, and decreasing a difference in flow resistance of three parallel portions of the refrigerant circuit from the first bifurcate flow divider 1 to the fourth bifurcate flow divider 4.

As above, the air-conditioning apparatus 200 according to Embodiment 7 further reduces the refrigerant flow rate deviation of the outdoor heat exchangers 30 caused by the flow resistance of the connection pipe 20 of the trifurcate distributor 10 by decreasing the difference in flow resistance of the three parallel portions of the refrigerant circuit from the first bifurcate flow divider 1 to the fourth bifurcate flow divider 4. Consequently, the air-conditioning apparatus 200 can further reduce a deviation of heat exchanging amounts of the three outdoor heat exchangers 30, and therefore is enhanced in heat exchange performance and can enhance energy saving performance.

Figure 29:
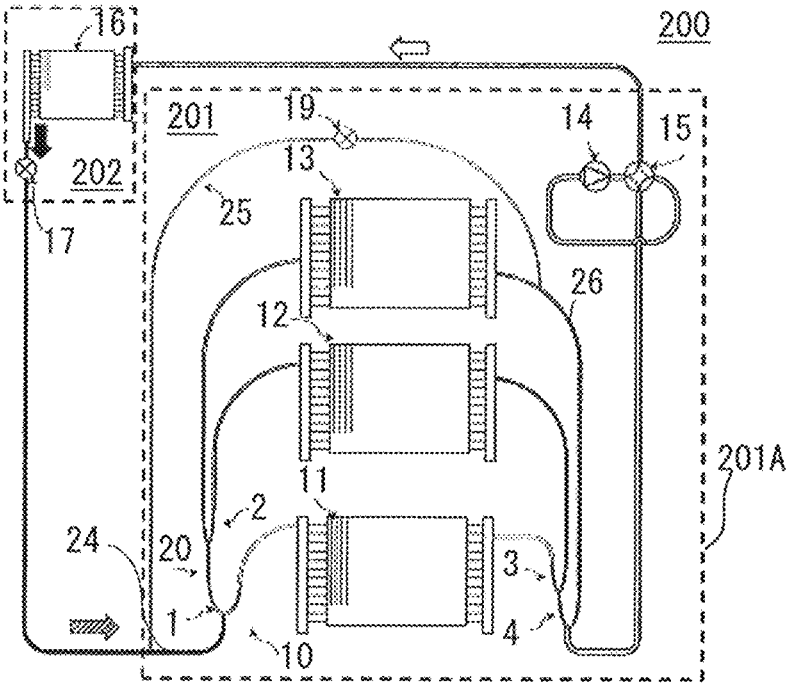
FIG. 29 is a configuration diagram of a modified example of the air-conditioning apparatus according to Embodiment 7 of the present invention.

FIG. 29 is a configuration diagram of a modified example of the air-conditioning apparatus 200 according to Embodiment 7 of the present invention. The outdoor unit 201 has an inlet port side refrigerant pipe 24 connecting a decompressing device 17 and the first bifurcate flow divider 1, and an outlet port side refrigerant pipe 26 connecting the third outdoor heat exchanger 13 and the fourth bifurcate flow divider 4. The air-conditioning apparatus 200 includes a bypass passage 25 connected to between the inlet port side refrigerant pipe 24 and the outlet port side refrigerant pipe 26, and including a flow control valve 19.

The air-conditioning apparatus 200 can divide a part of the refrigerant into the outlet port side refrigerant pipe 26 connecting the third outdoor heat exchanger 13 and the fourth bifurcate flow divider 4. In the outlet port side refrigerant pipe 26, the flow resistance is relatively small among three portions of the refrigerant circuit from the first bifurcate flow divider 1 to the fourth bifurcate flow divider 4. The air-conditioning apparatus 200 increases the flow rate of the outlet port side refrigerant pipe 26 connecting the third outdoor heat exchanger 13 and the fourth bifurcate flow divider 4 to increase pressure loss, and thereby can decrease the refrigerant flow rate deviation of the first outdoor heat exchanger 11, the second outdoor heat exchanger 12, and the third outdoor heat exchanger 13. As a result, the air-conditioning apparatus 200 can reduce the deviation of the heat exchange amounts of the three outdoor heat exchangers 30, and therefore is enhanced in heat exchange performance and can enhance energy saving performance.

Figure 30:
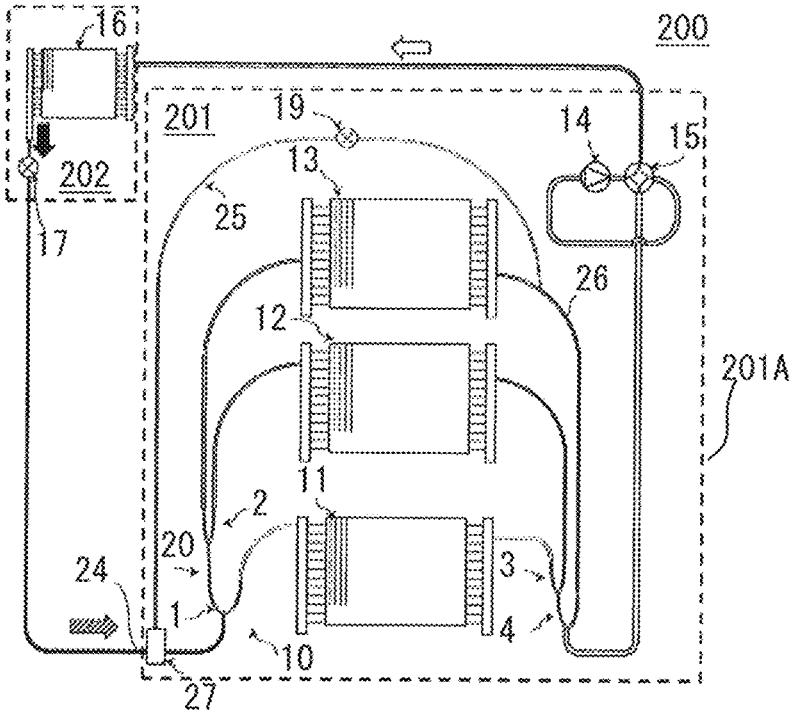
FIG. 30 is a configuration diagram of another modified example of the air-conditioning apparatus according to Embodiment 7 of the present invention.

FIG. 30 is a configuration diagram of another modified example of the air-conditioning apparatus 200 according to Embodiment 7 of the present invention. As shown in FIG. 30, in the other modified example of the air-conditioning apparatus 200 according to Embodiment 7 of the present invention, a gas-liquid separator 27 is provided at a connection portion of the inlet port side refrigerant pipe 24 connecting the decompressing device 17 and the first bifurcate flow divider 1, and the bypass passage 25. By using the gas-liquid separator 27 at the connection portion of the inlet port side refrigerant pipe 24 and the bypass passage 25, the air-conditioning apparatus 200 can preferentially bypass the gas-phase refrigerant having a larger pressure loss than does the liquid-phase refrigerant. Furthermore, by using the gas-liquid separator 27 at the connection portion of the inlet port side refrigerant pipe 24 and the bypass passage 25, the air-conditioning apparatus 200 can also reduce quality of the refrigerant flowing to the first outdoor heat exchanger 11, the second outdoor heat exchanger 12, and the third outdoor heat exchanger 13. Consequently, the air-conditioning apparatus 200 enhances heat exchange performance in the outdoor heat exchangers 30, and can enhance energy saving performance of the air-conditioning apparatus.

Note that the embodiments of the present invention are not limited to Embodiments 1 to 7 described above, and various modifications can be added. For example, the third bifurcate flow divider 3 and the fourth bifurcate flow divider 4 merging between the outdoor heat exchangers 30 and the flow switching device 15 may be each the bifurcate flow divider as shown in FIG. 1, or may be a distributor having a plurality of branched pipes. Furthermore, the number of outdoor units 201 is not limited to one, but a plurality of outdoor units 201 may be connected. Furthermore, a plurality of indoor heat exchangers 16 may be provided as long as the decompressing device 17 is provided in the inlet port side refrigerant pipe 24 between the indoor heat exchangers 16 and the gas-liquid separator 27, and a plurality of indoor units 202 may be connected to be used in a variable refrigerant flow system. Furthermore, the inlet port side refrigerant pipe 24 connecting the decompressing device 17 and the trifurcate distributor 10 may be via a flow division controller to control refrigerant supplied to a plurality of indoor units 202, or may be via the gas-liquid separator 27. A kind of the refrigerant circulating in the air-conditioning apparatus 200 is not specially limited. As shown in FIG. 25, in the outdoor unit 201 of the air-conditioning apparatus 200, the distributors 31 distributing the refrigerant to the outdoor heat exchangers 30 are provided at right ends of the outdoor heat exchangers 30 in the horizontal direction of the outdoor heat exchangers 30. However, the installation position of the distributors 31 is not limited to the right ends of the outdoor heat exchangers 30, but the distributors 31 may be provided at left ends of the outdoor heat exchangers 30.

REFERENCE SIGNS LIST

1 first bifurcate flow divider 1*a* first pipe portion 1*b* second pipe portion 1*c* third pipe portion 2 second bifurcate flow divider 2*a* fourth pipe portion 2*b* fifth pipe portion 2*c* sixth pipe portion 3 third bifurcate flow divider 4 fourth bifurcate flow divider 10 trifurcate distributor 11 first outdoor heat exchanger 12 second outdoor heat exchanger 13 third outdoor heat exchanger 14 compressor 15 flow switching device 16 indoor heat exchanger 17 decompressing device 18 air-sending device 19 flow control valve 20 connection pipe 20A connection pipe 21 inlet pipe 21A inlet straight pipe portion 21B bent portion 21C straight pipe portion 22A first straight pipe portion 22B second straight pipe portion 22C third straight pipe portion 23A first curved pipe portion 23B second curved pipe portion 24 inlet port side refrigerant pipe 25 bypass passage 26 outlet port side refrigerant pipe 27 gas-liquid separator 30 outdoor heat exchanger 31 distributor 51 inflow port 52 outflow port 53 outflow port 54 inflow port 55 outflow port, 56 outflow port 100 liquid refrigerant 101 gas refrigerant 102 gas-liquid interface 111 plane 111A plane 112 plane 112A plane 113 intersection line 116 plane 117 plane 200 air-conditioning apparatus 201 outdoor unit 201A casing 202 indoor unit

The invention claimed is:

1. A refrigerant distributor branching refrigerant flowing in a refrigerant circuit into three, comprising:

a first bifurcate flow divider including a first pipe portion forming one inflow port at a lower end, a second pipe portion and a third pipe portion forming two outflow ports communicating with the inflow port of the first pipe portion, at upper ends; and a second bifurcate flow divider including a fourth pipe portion forming one inflow port at a lower end, and a fifth pipe portion and a sixth pipe portion forming two outflow ports communicating with the inflow port of the fourth pipe portion, at upper ends, the outflow port of the third pipe portion and the inflow port of the fourth pipe portion communicating with each other, an angle θ formed by a first plane passing through a center point of each of the one inflow port and the two outflow ports of the first bifurcate flow divider and a second plane passing through a center point of each of the one inflow port and the two outflow ports of the second bifurcate flow divider being 60 degrees or more and 120 degrees or less, a connection pipe having an upper end connecting to the fourth pipe portion vertically upward, and a lower end connecting to the third pipe portion, wherein the connection pipe includes at least one first curved pipe portion turning from upward to downward in a direction of gravity, and at least one second curved pipe portion turning from downward to upward in the direction of gravity, in a refrigerant flowing direction, and the connection pipe further includes a first straight pipe portion located between the first bifurcate flow divider and the at least one first curved pipe portion, and connecting to the third pipe portion, and a second straight pipe portion located between the second bifurcate flow divider and the at least one second curved pipe portion, and connecting to the fourth pipe portion, wherein the connection pipe includes a third straight pipe portion disposed between the at least one first curved pipe portion and the at least one second curved pipe portion, and having a lower end connecting to the at least one second curved pipe portion, and a length Lc of the third straight pipe portion is a length of 10Dc or more and 20Dc or less, where an inside diameter Dc of the third straight pipe portion is a unit.

2. The refrigerant distributor of claim 1, further comprising an inlet pipe having an upper end connecting to the first pipe portion vertically upward, and a lower end connecting to the refrigerant circuit, wherein the inlet pipe includes an inlet straight pipe portion having an upper end portion connecting to the first pipe portion vertically upward, and extending in an up-down direction, a bent portion having one end connected to a lower end portion of the inlet straight pipe portion, and bent in an arc shape, and a straight pipe portion forming a linear pipeline having one end connected to an other end of the bent portion, a length Ld of a portion of the straight pipe portion is a length of 10Dd or more and 20Dd or less, where an inside diameter Dd of the straight pipe portion is a unit, and an angle γ formed by a fourth plane passing through a center line of the inlet pipe and the first plane is 60 degrees or more and 120 degrees or less.

3. An air-conditioning apparatus, comprising:

a compressor configured to compress refrigerant;

a decompressing device including a valve and configured to expand refrigerant and decompress the refrigerant;

at least three outdoor heat exchangers each configured to exchange heat between refrigerant and outdoor air, and connected in parallel to each other in a portion of a refrigerant circuit between the decompressing device and the compressor; and at least one refrigerant distributor connected to inlet ports of the at least three outdoor a heat exchangers, each of the at least one refrigerant, distributor including a first bifurcate flow divider including a first pipe portion forming one inflow port at a lower end, a second pipe portion and a third pipe portion forming two outflow ports communicating with the inflow port of the first pipe portion, at upper ends, and a second bifurcate flow divider including a fourth pipe portion forming one inflow port at a lower end, and a fifth pipe portion and a sixth pipe portion forming two outflow ports communicating with the inflow port of the fourth pipe portion, at upper ends, the outflow port of the third pipe portion and the inflow port of the fourth pipe portion communicating with each other by a connection pipe that includes at least one first curved pipe portion turning 180 degrees and at least one second curved pipe portion turning 180 degrees, and an angle θ formed by a first plane passing through a center point of each of the one inflow port and the two outflow ports of the first bifurcate flow divider and a second plane passing through a center point of each of the one inflow port and the two outflow ports of the second bifurcate flow divider being 60 degrees or more and 120 degrees or less, the air-conditioning apparatus, further comprising an air-sending device including a fan and arranged above the at least three outdoor heat exchangers, wherein the at least three outdoor heat exchangers are arranged in an up-down direction, and a first outdoor heat exchanger connecting to the second pipe portion is disposed above a second outdoor heat exchanger connecting to the fifth pipe portion and a third outdoor heat exchanger connecting to the sixth pipe portion.

4. An air-conditioning apparatus, comprising:

a compressor configured to compress refrigerant;

a decompressing device including a valve and configured to expand refrigerant and decompress the refrigerant;

at least three outdoor heat exchangers each configured to exchange heat between refrigerant and outdoor air, and connected in parallel to each other in a portion of a refrigerant circuit between the decompressing device and the compressor; and at least one refrigerant distributor connected to inlet ports of the at least three outdoor a heat exchangers, each of the at least one refrigerant distributor including a first bifurcate flow divider including a first pipe portion forming one inflow port at a lower end, a second pipe portion and a third pipe portion forming two outflow ports communicating with the inflow port of the first pipe portion, at upper ends, and a second bifurcate flow divider including a fourth pipe portion forming one inflow port at a lower end, and a fifth pipe portion and a sixth pipe portion forming two outflow ports communicating with the inflow port of the fourth pipe portion, at upper ends, the outflow port of the third pipe portion and the inflow port of the fourth pipe portion communicating with each other by a connection pipe that includes at least one first curved pipe portion turning 180 degrees and at least one second curved pipe portion turning 180 degrees, and an angle θ formed by a first plane passing through a center point of each of the one inflow port and the two outflow ports of the first bifurcate flow divider and a second plane passing through a center point of each of the one inflow port and the two outflow ports of the second bifurcate flow divider being 60 degrees or more and 120 degrees or less, the air-conditioning apparatus, further comprising an air-sending device including a fan and arranged above the at least three outdoor heat exchangers, wherein the at least three outdoor heat exchangers are arranged in a horizontal direction, and a first outdoor heat exchanger connecting to the second pipe portion has a larger area facing toward an outer peripheral surface of a casing of an outdoor unit storing the at least three outdoor heat exchangers than an area of a second outdoor heat exchanger facing toward the outer peripheral surface and than an area of a third outdoor heat exchanger facing toward the outer peripheral surface, the second outdoor heat exchanger connecting to the fifth pipe portion, the third outdoor heat exchanger connecting to the sixth pipe portion.

5. The air-conditioning apparatus of claim 4, wherein, where a length in a short-side direction of the casing is specified as X, and a length in a longitudinal direction of the casing is specified as Y, in plan view, a ratio Y/X of the lengths of the casing is larger than 2 and smaller than 4, and the first outdoor heat exchanger is disposed in the longitudinal direction of the casing, the second outdoor heat exchanger and the third outdoor heat exchanger are disposed on remaining portions of the outer peripheral surface of the casing, an end portion of the second outdoor heat exchanger and an end portion of the third outdoor heat exchanger facing each other are bent inward of the casing, the second outdoor heat exchanger and the third outdoor heat exchanger each include a ventilation face, and the ventilation faces face each other at a distance of 100 mm or less.

6. The air-conditioning apparatus of claim 3, wherein an outlet port of the first outdoor heat exchanger connecting to the second pipe portion, and an outlet port of the second outdoor heat exchanger connecting to the fifth pipe portion are connected to a third bifurcate flow divider, and an outlet port of the third bifurcate flow divider, and an outlet port of the third outdoor heat exchanger connecting to the sixth pipe portion are connected with a fourth bifurcate flow divider.

7. The air-conditioning apparatus of claim 6, comprising a bypass passage connected to between an inlet port side refrigerant pipe connecting the decompressing device and the first bifurcate flow divider, and an outlet port side refrigerant pipe connecting the third outdoor heat exchanger and the fourth bifurcate flow divider, and having a flow control valve.

8. The air-conditioning apparatus of claim 7, comprising a gas-liquid separator at a connection portion of the inlet port side refrigerant pipe and the bypass passage.

* * * * *